US005885742A

United States Patent [19]

Okado et al.

[11] Patent Number: 5,885,742

[45] Date of Patent: Mar. 23, 1999

[54] CARRIER FOR ELECTROPHOTOGRAPHY, TWO-COMPONENT TYPE DEVELOPER, AND IMAGE FORMING METHOD

[75] Inventors: Kenji Okado, Yokohama; Toshiyuki Ugai, Tokyo; Ryoichi Fujita; Tsuyoshi Takiguchi, both of Kawasaki, all of Japan

[73] Assignee: Canon Kabushiki Kaisha, Tokyo, Japan

[21] Appl. No.: 943,698

[22] Filed: Oct. 3, 1997

Related U.S. Application Data

[63] Continuation of Ser. No. 674,711, Jul. 2, 1996, abandoned, which is a continuation of Ser. No. 323,111, Oct. 14, 1994, abandoned.

[30] Foreign Application Priority Data

| | | | |
|---|---|---|---|
| Oct. 15, 1993 | [JP] | Japan | 5-258491 |
| Oct. 15, 1993 | [JP] | Japan | 5-280642 |
| Oct. 15, 1993 | [JP] | Japan | 5-280643 |
| Feb. 28, 1994 | [JP] | Japan | 6-052582 |

[51] Int. Cl.[6] ..... G03G 9/113

[52] U.S. Cl. ..... 430/108; 430/111; 430/122

[58] Field of Search ..... 430/106.6, 108, 430/111, 120, 122

[56] References Cited

U.S. PATENT DOCUMENTS

| | | | |
|---|---|---|---|
| 2,221,776 | 11/1940 | Carlson | 95/5 |
| 2,297,691 | 10/1942 | Carlson | 95/5 |

(List continued on next page.)

FOREIGN PATENT DOCUMENTS

| | | | |
|---|---|---|---|
| 0351712 | 1/1990 | European Pat. Off. | G03G 9/10 |
| 42-23910 | 11/1967 | Japan . | |

(List continued on next page.)

OTHER PUBLICATIONS

*Chemistry and Technology of Silicones*, W. Noll, Academic Press, NY, pp. 1–17 (1968).

Patent Abstracts of Japan, vol. 11, No. 261 (P–609) [2708], Aug. 25, 1987 & JP–A–62 066267 (Konishiroky Photo), Mar. 25, 1987.

Patent Abstracts of Japan, vol. 11, No. 362 (P–640) [2809], Nov. 26, 1987 & JP–A–62 136674 (Canon), Jun. 19, 1987.

Patent Abstracts of Japan, vol. 12, No. 231 (p.–723) [3078], Jun. 30, 1988 & JP–A–63 021678 (Canon), Jan. 29, 1988.

Patent Abstracts of Japan, vol. 4, No. 177 (P–39), Dec. 9, 1980 & JP–A–55 120043 (Canon), Sep. 16, 1980.

Aoki, et al., "Color Reproduction of PPC Color Copier", J. of Electrophotographic Soc., vol. 22, No. 1, pp. 7–16 (1983).

Suzuki, "Tone Reproduction . . . ", J. Electrophotog. Soc., vol. 25, No. 1, p. 52 (1986).

*Primary Examiner*—Christopher D. Rodee

*Attorney, Agent, or Firm*—Fitzpatrick, Cella, Harper & Scinto

[57] ABSTRACT

A carrier for electrophotography has carrier particles. Each carrier particle has a carrier core and a silicone resin coat layer that covers the carrier core. The carrier particle has silicon atoms and carrier atoms on its surface in the ratio that satisfies the condition of Si/C=0.1 to 2.0 as the number of atoms present on the carrier particle surface as measured by X-ray photoelectron spectroscopy, and from 0.1% by number to 5% by number of metal atoms are present on the carrier particle surface. Additionally, there is a two-component developer for developing electrostatic images which consists of a toner and the carrier. An image forming method in which the two-component developer having the toner and the carrier is transported to a developing zone which is defined by a latent image carried on a latent image bearing member to develop the latent image. A voltage is applied to the developer to direct the toner from the latent image bearing member to a member carrying the developer. A second voltage directs the toner from the developer toward the latent image and a third voltage developer the latent image using the toner of the two-component developer.

67 Claims, 3 Drawing Sheets

U.S. PATENT DOCUMENTS

| | | | |
|---|---|---|---|
| 2,618,552 | 11/1952 | Wise | 95/1.9 |
| 2,874,063 | 2/1959 | Greig | 117/17.5 |
| 3,840,464 | 10/1974 | Van Engeland et al. | 252/62.1 |
| 3,849,127 | 11/1974 | Madrid et al. | 96/1 SD |
| 3,909,258 | 9/1975 | Kotz | 96/1 R |
| 4,977,054 | 12/1990 | Honjo et al. | 430/106.6 |
| 5,116,711 | 5/1992 | Kobayashi et al. | 430/106 |
| 5,173,387 | 12/1992 | Niki et al. | 430/110 |
| 5,219,696 | 6/1993 | Demizu et al. | 430/111 |
| 5,256,512 | 10/1993 | Kobayashi et al. | 430/106 |
| 5,260,159 | 11/1993 | Ohtani et al. | 430/108 |
| 5,288,579 | 2/1994 | Tanaka et al. | 430/110 |
| 5,306,588 | 4/1994 | Tanaka et al. | 430/110 |
| 5,385,801 | 1/1995 | Terasaka et al. | 430/111 |

FOREIGN PATENT DOCUMENTS

| | | |
|---|---|---|
| 43-24748 | 10/1968 | Japan . |
| 47-13954 | 7/1972 | Japan . |
| 49-70630 | 7/1974 | Japan . |
| 51-03238 | 1/1976 | Japan . |
| 52-32256 | 8/1977 | Japan . |
| 55-127569 | 10/1980 | Japan . |
| 56-32149 | 4/1981 | Japan . |
| 56-64352 | 6/1981 | Japan . |
| 58-23032 | 2/1983 | Japan . |
| 58-144839 | 8/1983 | Japan . |
| 59-52255 | 3/1984 | Japan . |
| 60-112052 | 6/1985 | Japan . |
| 60-208765 | 10/1985 | Japan . |
| 60-208767 | 10/1985 | Japan . |
| 61-160760 | 7/1986 | Japan . |
| 61-204646 | 9/1986 | Japan . |
| 62-63970 | 3/1987 | Japan . |
| 2-33159 | 2/1990 | Japan . |
| 2-281280 | 11/1990 | Japan . |

CARRIER FOR ELECTROPHOTOGRAPHY, TWO-COMPONENT TYPE DEVELOPER, AND IMAGE FORMING METHOD

This application is a continuation of application Ser. No. 08/674,711, filed Jul. 2, 1996, now abandoned, which, in turn, is a continuation of application Ser. No. 08/323,111 filed Oct. 14, 1994, now abandoned.

BACKGROUND OF THE INVENTION

1. Field of the Invention

The present invention relates to a carrier for electrophotography which composes a two-component type developer used to develop an electrostatic image in electrophotography, electrostatic recording or electrostatic printing. It also relates to a two-component type developer making use of the carrier, and an image forming method carried out using the two-component type developer.

2. Related Background Art

It is conventionally known to form an image on the surface of a photoconductive material by an electrostatic means.

A large number of methods are known as electrophotography, as disclosed in U.S. Pat. No. 2,297,691 Japanese Patent Publications No. 42-23910 and No. 43-24748 and so forth. In general, an electrostatic latent image is formed on a photosensitive member, utilizing a photoconductive material and according to various means, and subsequently a very finely divided electrodetective material called a toner is made to adhere to the latent image to form a toner image corresponding to the electrostatic latent image.

Next, the toner image is transferred to an image holding medium such as paper if necessary, followed by fixing by the action of heat, pressure, or solvent vapor. A copy is thus obtained. When the process comprises a toner-image transfer step, the process is usually provided with the step of removing the toner remaining on the photosensitive member.

As developing methods by which the electrostatic latent image is formed into a visible image by the use of a toner, known methods can be exemplified by the powder cloud development as disclosed in U.S. Pat. No. 2,221,776, the cascade development as disclosed in U.S. Pat. No. 2,618,552, the magnetic brush development as disclosed in U.S. Pat. No. 2,874,063, and the method in which a conductive magnetic toner is used, as disclosed in U.S. Pat. No. 3,909,258, as well as what is called the J/B development as disclosed in Japanese Patent Application Laid-open No. 62-63970, in which a bias electric field comprised of an AC component and a DC component is applied across a developer carrying member (a developing sleeve) and a photoconductive layer to carry out development.

Among these, the magnetic brush development can be noted as a representative process. In this process, magnetic particles such as steel powder or ferrite powder are used as a carrier, and a developer comprised of a toner and such a magnetic carrier is held with a magnet so that the developer is arranged in the form of a brush by the action of a magnetic field of the magnet. The magnetic brush thus formed is brought into contact with the electrostatic latent image surface on a photoconductive layer, whereupon only the toner is attracted toward the electrostatic latent image from the brush to carry out development.

The carrier that composes such a two-component type developer used in these development processes can be roughly grouped into a conductive carrier and an insulative carrier. The conductive carrier is usually comprised of oxidized or unoxidized iron powder. A developer composed of this iron powder carrier, however, has the problems that the triboelectric chargeability to a toner is unstable and also that fog may be generated on a visible image formed using the developer. More specifically, as the developer is used, toner particles adhere to and accumulate (spent toner) on the surfaces of the iron powder carrier particles, so that the electrical resistance of carrier particles increases to lower bias currents, and also to make the triboelectric chargeability unstable, resulting in a lowering of the image density of a visible image formed and an increase of fog. Thus, when copies are continuously taken by an electrophotographic copying machine using the developer containing the iron powder carrier, the developer may deteriorate upon copying several times and hence it becomes necessary to change the developer at an early stage, resulting in a high cost after all.

The insulative carrier is commonly typified by a carrier comprising carrier core particles comprised of a ferromagnetic material such as iron, nickel or ferrite whose surfaces are uniformly coated with an insulating resin. A developer that employs this carrier may cause little the melt-adhesion of toner particles to the carrier surfaces, compared with the case of the conductive carrier, and at the same time the triboelectric chargeability of a carrier to a toner can be controlled with ease. Hence, the developer has the advantage that it is suitable particularly for high-speed electrophotographic copying machines in view of its superior durability and long lifetime.

There are various performances required for the insulative carrier. Particularly important performances can be set out as proper chargeability, impact resistance, wear resistance, a good adhesion between cores and coating materials, and uniformity in charge distribution.

Taking account of the above required performances, insulative carriers hitherto used still leave room for improvements, and no perfect carrier is known at present. For example, use of an acrylic resin as a coating material for carriers is disclosed in Japanese Patent Applications Laid-open No. 47-13954 and No. 60-208765. In particular, its molecular weight configuration is disclosed in Japanese Patent Application Laid-open No. 60-208767, and it is known to constantly control molecular weights so that the chargeability of coated carriers can be stabilized. However, making a coating resin adhere to carrier cores tends to be affected by conditions set in apparatus and environments where the carrier cores are coated, in particular, by humidity. Even if these have been severely controlled, no satisfactory measures are available for making the resin stably adhere to cores to achieve sufficient chargeability and durability. This is the present situation of the matter.

Meanwhile, in order to prevent carrier spent such as melt-adhesion of toner, it is proposed to use as a coating material a resin having a small surface energy so as to improve durability, and the resin having a small surface energy is exemplified by silicone resin.

The silicone resin is advantageous in that it has not only a low surface tension but also a high water repellency. On the other hand, the silicone resin is problematic in that it has so poor an adhesion that coat layers formed tend to separate.

In order to overcome such a problem, proposals are made as exemplified by a method in which a resin-modified silicone resin is used (Japanese Patent Application Laid-open No. 55-127569), a method in which vinyl silane is incorporated to cause it to react with other resin (Japanese Patent Application Laid-open No. 56-32149), a method in which a mixture of a trialkoxysilane and ethyl cellulose is used (U.S. Pat. No. 3,840,464) and a method in which a mixture of an organosilicone terpolymer and a polyphenylene resin is used (U.S. Pat. No. 3,849,127). There, however, have been the problems that a high temperature of 300° C. or above is required to form its coat layers, and the silicone resin has so poor a compatibility with other resins that the coating layers become non-uniform and no expected performance can be obtained. It is also proposed to prepare coat layers at a relatively low curing temperature (Japanese Patent Application Laid-open No. 55-127569). Such coat layers, however, tend to wear because of their unsatisfactory adhesion and unsatisfactory toughness. For example, in the course of strong and long-term agitation of developer in a developing assembly of a high-speed copying machine, where carrier particles collide against the inner wall of the developing assembly and the surface of a photosensitive member, the silicone resin coat layers wear and separate to cause a change in triboelectric charging from the charging between toner and silicone resin to the charging between toner and carrier cores, so that the quantity of charges of the developer can not be kept constant, causing a deterioration of image quality.

In recent years, a rapid progress is being made from monochromatic copying to full-color copying, and researches are made on two-color copying machines or full-color copying machines, which have been already put into practical use. For example, Journal of Electrophotographic Society, Vol. 22, No. 1, pp. 7–16, (1983) and Journal of Electrophotographic Society, Vol. 25, No. 1, p.52 (1986) make reports relating to color reproduction and gradation reproduction.

Images formed by full-color electrophotography presently put into practical use, however, are not necessarily satisfactory for those who are accustomed to seeing color pictures that are by no means immediately compared with the actual object or original and also processed more beautifully than the actual object or original, as in television pictures, photographs and color prints.

In full-color electrophotography, color images are commonly formed using color toners of yellow, magenta and cyan three colors to reproduce all colors.

Its process comprises the step of forming an electrostatic latent image on a photoconductive layer through a color-separating light-transmitting filter having the relation of complementary color to the color of a toner, followed by developing and transfer steps, through which a toner image is held on an image holding medium. These steps are repeated several times to superimpose toner images on the same medium while making registration, followed by fixing carried out once to obtain a final full-color image.

In general, in the case of development carried out using the developer of what is called a two-component system comprised of a toner and a carrier, the toner is electrostatically charged to the desired charge quantity and charge polarity by its friction with the carrier, and the electrostatic attraction force produced is utilized to develop electrostatic images. Accordingly, in order to obtain good visible images, the triboelectric chargeability of toner that mainly depends on the relation with the carrier must be kept good.

It is also an important point how the carrier is prevented from deterioration in long-term use. After copies have been taken for a long term, the carrier deteriorates because of deposits formed thereon and changes in properties of its particle surfaces, so that its ability to provide charges to the toner becomes weak to cause toner scatter and faulty images such as fog.

Nowadays, to cope with such problems, a variety of researches are made, e.g, investigations are made on carrier core materials and carrier coat materials, coating weights are made optimum, charge control agents and fluidity-providing agents to be added to toners are studied, and also binders serving as base materials are improved, all of which are made so that a superior triboelectric chargeability can be achieved in the materials that compose developers.

For example, as techniques to add a charging auxiliary such as chargeable fine particles to the toner, Japanese Patent Publication No. 52-32256 and Japanese Patent Application Laid-open No. 56-64352 disclose adding a resin powder having a polarity reverse to the toner, and Japanese Patent Application Laid-open No. 61-160760 discloses adding a fluorine-containing compound, which are added to developers so as to achieve a stable triboelectric chargeability. Nowadays, many charging auxiliaries are also being advanced.

Various measures are also taken as methods for adding such a charging auxiliary. For example, it is common to use a method in which electrostatic attraction force or van der Waals force, acting between toner particles and the charging auxiliary, is utilized to cause the latter to adhere to the toner particle surfaces, where a stirrer, a mixer or the like is used. In such a method, however, it is not easy to uniformly disperse the additive on the toner particle surfaces, and also additive particles not adhering to toner particles may form agglomerates to make it difficult to prevent the presence of additives brought into what is called a free state. This tends to more frequently occur with an increase in specific electrical resistance of the charging auxiliary and with a decrease in particle diameter. In such a case, an influence on the developer may come therefrom. For example, the toner comes to have an insufficient quantity of triboelectricity, resulting in non-uniform image densities and images with much fog.

The above method also have the disadvantage that the content of the charging auxiliary changes when copies are continuously taken, to make it impossible to keep image quality at the initial stage.

As another method for its addition, there is a method in which the charging auxiliary is previously added together with a binder resin and a colorant when toners are produced. However, the amount of the charging auxiliary added or the dispersion thereof on the toner particle surfaces can not be controlled with ease since charge control agents can not be made uniform with ease and also since what substantially contribute to charging performance are charging auxiliaries and charge control agents present in the vicinity of toner particle surfaces and those present inside the particles do not contribute to the charging performance. The quantity of triboelectricity is unstable also in toners obtained by such a method. Thus, as previously stated, under existing circumstances, those having a well satisfactory quality have not been available only if the charging auxiliary is used, like the case when those satisfying developer performances can not be obtained with ease.

Moreover, in recent years, there is an increasing commercial demand for making copying machines achieve greater miniturazation and making images have a higher quality. In the present technical field, it is attempted to make toner particle diameter smaller so that a color image can be formed in a high image quality. Making smaller the particle diameters of toner particles results in an increase in the surface area per unit weight, tending to bring about an excessively large quantity of triboelectricity of the toner. This is accompanied with a possibility of the insufficiency of image density or the deterioration of durability or running performance. In addition, because of the large quantity of triboelectricity, toner particles may strongly adhere to one another to cause a decrease in fluidity, bringing about a problem in the stability of toner feeding and the providing of triboelectricity to the toner.

In the case of color toners, they contain no conductive materials such as magnetic materials and carbon black, and hence have no portions from which charges are leaked to commonly tend to have a larger quantity of triboelectricity. This tendency is more remarkable when polyester type binders having a high charging performance is used.

In particular, color toners are strongly desired to have performances as shown below.

(1) Fixed toners are required to nearly come into a substantially completely molten state to the extent that the forms of toner particles can not be recognized, so as for their color reproduction not to be hindered because of irregular reflection upon exposure to light.

(2) Color toners must have a transparency not to obstruct the toner layer having a different color tone that lies beneath an upper layer thereof.

(3) The respective constituent toners must have well-balanced hues and spectral reflection properties, and sufficient chroma.

From such viewpoints, studies are made on many binder resins. However, none of toners that satisfy all of the above performances have brought out. Nowadays, in the present technical field, resins of a polyester type are widely used as binder resins for color toners. Toners comprised of a polyester resin, however, commonly tend to be affected by temperature and humidity, and tend to cause problems of an excessive charge quantity in an environment of low humidity and an insufficient charge quantity in an environment of high humidity.

Moreover, when some additives are added for the purpose of overcoming such disadvantages, carrier contamination may come into question. This inhibits charging performance of carriers to cause a decrease in charge quantity and cause image fog and toner scatter. Hence, it is sought to design carriers having a high contamination resistance to the additives. Accordingly, as a matter of course, carriers must be so designed as to have a good charging performance, and it is of urgent to make advancement of color toners that can have stable charges over a wide range of environments and also to design carriers for accomplishing color developers having a lifetime long enough to maintain good images over a long period of time as a role of developers.

Meanwhile, in the aforesaid development of electrostatic latent images, a toner with a fine particle diameter is blended with a carrier formed of relatively large particles and is used as a developer for electrophotography. The composition of both the toner and the carrier is selected so that as a result of their mutual contact friction the toner can have a polarity reverse to the charges present on the photoconductive layer. As a result of contact friction between the both, the carrier further electrostatically attracts the toner to its particle surfaces to transport the toner as a developer through a developing assembly and also feed the toner onto the photoconductive layer.

When, however, copies are continuously taken on a large number of copy sheets by an electrophotographic copying apparatus using such a two-component type developer, although sharp images with a good image quality can be obtained at the initial stage, edge effect with much fog may seriously occur after copies have been taken on several tens of thousands of sheets, resulting in images having poor gradation and sharpness.

In color copying carried out using toners with chromatic colors, continuous gradation is an important factor that influences image quality, and the edge effect that stresses only margins of images, occurring after copies have been taken on a large number of copy sheets, greatly damages the gradation of images. For example, quasi-contours due to the edge effect are formed in the vicinity of actual contours, resulting in a loss of reproducibility including color reproducibility in color copying. Image area used in conventional black and white copying is 10% or less and images are almost held by line images as in letters, documents, reports and so forth. On the other hand, in the case of color copying, image area is 20% at least, and images are held by gradational solid images at a reasonable frequency or occupancy as in photographs, catalogues, maps, pictures and so on.

When copies are continuously taken using such originals having a large image area, reproductions with a high image density can be obtained at the initial stage in usual instances, but the feeding of toner to the two-component type developer may become insufficient with time to cause a decrease in density, or the toner being fed and the carrier may mix in the state of charge insufficiency to cause fog or cause a local increase or decrease in toner concentration (which indicates toner-carrier mixing ratio) on the developing sleeve, tending to result in blurred images or non-uniform image density. This tendency becomes more noticeable when the toner has a smaller particle diameter.

Such under-development and fog are presumed to be caused by an excessively low toner content (i.e., toner concentration) in developer or a poor rise for rapid triboelectric charging between the toner being fed and the carrier contained in the two-component type developer, where any uncontrollable, insufficiently charged toner thereby produced participates in development. It is essential for color developers to have the ability to always output images with a good image quality in the continuous copying of originals having a large image area. To deal with originals having a large image area and requiring a very large toner consumption, measures hitherto taken have more relied on improvements of developing apparatus than improvements of developers themselves. That is, it has been attempted to increase the peripheral speed of a developing sleeve or make a developing sleeve have a larger diameter so that the developing sleeve can be brought into contact with electrostatic latent images more times.

Such measures can be effective for improving developability, but may greatly limit the lifetime of apparatus because of an in-machine contamination due to toner scatter occurring in developing assemblies or because of an overload on the drive of developing assemblies. In some instances, measures are also taken in which developers are put in developing assemblies in large quantities in order to compensate the insufficiency of developability of the developers. Such measures, however, cause an increase in weight of copying machines, a cost increase due to the apparatus that must be made larger in size and an overload on the drive of developing assemblies as in the above case, and are not so much preferable.

Now, studies are reported on improvements made from both directions of toners and carriers for the purpose of maintaining a high image quality over a long period of running.

For example, Japanese Patent Applications Laid-open No. 51-3238, No. 58-144839 and No. 61-204646 suggest average particle diameter and particle size distribution of carriers. Of these, Japanese Patent Application Laid-open No. 51-3238 makes reference to a rough particle size distribution. It, however, has no specific disclosure as to magnetic properties closely concerned with developing performance of developers or transport performance thereof in developing apparatus. Moreover, carriers used in Examples all contain particles with a size of 250 mesh-pass or larger in an amount of as large as about 80% by weight or more and also have an average particle diameter of 60 $\mu$m or larger.

Japanese Patent Application Laid-open No. 58-144839 only discloses average particle diameter of a carrier. It makes reference to the quantity of fine powder that influences the adhesion of carriers to photosensitive members and the quantity of coarse powder that influences the sharpness of images. It takes account of performance of color copying, and has no detailed disclosure as to particle size distribution of carriers. As for Japanese Patent Application Laid-open No. 61-204646, it discloses as the gist of the invention a combination of a copying machine with a suitable developer, and has no specific disclosure as to the particle size distribution or magnetic properties of carriers. It still also has no disclosure as to why such a developer is effective for copying apparatus.

Japanese Patent Application Laid-open No. 49-70630 has a disclosure relating to magnetic force of carriers, which, however, is concerned with iron powders used as carrier materials, having a larger specific gravity than ferrites, also having a high saturation magnetization. Such iron powder carriers have been hitherto put into wide use, but tend to make the weight of copying machines larger or cause an overload on drive torque, and also have a large environmental dependence.

A ferrite carrier disclosed in Japanese Patent Application Laid-open No. 58-23032 concerns a porous material with many voids. Such a carrier tends to cause the edge effect, having a poor durability, and has been found to be unsuitable for color copy carriers.

It has long been sought to provide a developer that enables continuous reproduction of images with a large image area, using a developer in a small quantity, and can satisfy the performance specific to color copying that no edge effect may occur even after running. Studies are made on developers and carriers, almost all of which, however, are proposed taking account of black and white copying, and only a little of which are proposed as those applicable also to full-color copying. It is also sought to provide a carrier having the ability to continue reproduction of images having an image area of 20% or more, which are nearly solid images, and having the ability to decrease the edge effect and retain the uniformity of image density on a sheet of reproduction.

Under such circumstances, the present inventors have proposed, as disclosed in Japanese Patent Application Laid-open No. 2-281280, a carrier with a narrow particle size distribution in which the presence of fine powder and the presence of coarse powder have been quantitatively controlled, to achieve a carrier improved in developing performance.

However, as previously stated, there is an increasing commercial demand for making copying machines achieve a higher minuteness and making images have a higher quality. In the present technical field, it is attempted to make toner particle diameter smaller so that a color image can be formed in a high image quality. Making the particle diameters of toner particles smaller results in an increase in the surface area per unit weight, tending to bring about an excessively large quantity of triboelectricity of the toner. This is accompanied with a possibility of the insufficiency of image density or the deterioration of running performance.

Thus, for the purpose of preventing the insufficiency of image density or the deterioration of running performance, caused by the toner made to have a smaller particle diameter, or for the purpose of improving development efficiency, it is attempted to make carrier particles have a smaller diameter. Such carriers, however, have achieved no quality high enough to stand against changes in the environment of toners or changes in the quantity of triboelectricity after running.

SUMMARY OF THE INVENTION

An object of the present invention is to provide a carrier for electrophotography, having solved the problems discussed above, a two-component type developer making use of such a carrier, and an image forming method making use of such a two-component type developer.

Another object of the present invention is to provide a carrier for electrophotography, that can enjoy an improved rise of charging of toner, may hardly cause adhesion of a toner external additive such as titanium oxide, and also may hardly cause charge-up in an environment of low humidity and leak of charges in an environment of high humidity so that the toner can be well electrostatically charged and stable images can be obtained in all environments; a two-component type developer making use of such a carrier; and an image forming method making use of such a two-component type developer.

Still another object of the present invention is to provide a carrier for electrophotography, that can impart sufficient negative charges to toner and also have a high resistance to physical impact to hardly cause separation of coat layers; a two-component type developer making use of such a carrier; and an image forming method making use of such a two-component type developer.

A further object of the present invention is to provide a carrier for electrophotography, having a superior chargeability in all environments, a superior mechanical strength, a superior adhesion of coat layers to carrier cores and a good durability; a two-component type developer making use of such a carrier; and an image forming method making use of such a two-component type developer.

A still further object of the present invention is to provide a carrier for electrophotography, that may cause no decrease in image density and no blurred images even when color originals with a large image area are continuously copied; a two-component type developer making use of such a carrier; and an image forming method making use of such a two-component type developer.

A still further object of the present invention is to provide a carrier for electrophotography, that can enjoy a rapid rise of triboelectric charging between toner and carrier, a two-component type developer making use of such a carrier, and an image forming method making use of such a two-component type developer.

A still further object of the present invention is to provide a carrier for electrophotography, that can achieve a good transport performance in developing assemblies, a two-component type developer making use of such a carrier, and an image forming method making use of such a two-component type developer.

A still further object of the present invention is to provide a carrier for electrophotography, that can achieve fog-free, sharp image characteristics, a high image density, and superior highlight reproduction and fine-line reproduction; a two-component type developer making use of such a carrier; and an image forming method making use of such a two-component type developer.

The present invention provides a carrier for electrophotography comprising carrier particles; each carrier particle comprising a carrier core and a silicone resin coat layer that covers the carrier core, wherein;

the carrier particle has silicon atoms and carbon atoms on its surface in the ratio that satisfies the condition of:

Si/C=0.1 to 2.0 as the number of atoms present on the carrier particle surface as measured by XPS (X-ray photoelectron spectroscopy); and from 0.1% by number to 5% by number of metal atoms are present on the carrier particle surface.

The present invention also provides a two-component type developer for developing electrostatic images, comprising a toner and a carrier; the carrier comprising carrier particles, and each carrier particle comprising a carrier core and a silicone resin coat layer that covers the carrier core, wherein;

the carrier particle has silicon atoms and carbon atoms on its surface in the ratio that satisfies the condition of:

Si/C=0.1 to 2.0 as the number of atoms present on the carrier particle surface as measured by XPS; and from 0.1% by number to 5% by number of metal atoms are present on the carrier particle surface.

The present invention still also provides an image forming method comprising;

rotationally transporting a two-component type developer having a toner and a carrier, onto a developer carrying member; and developing in a developing zone defined by a latent image bearing member and the developer carrying member provided opposingly thereto, a latent image beared on the latent image bearing member, using a toner of the two-component type developer carried on the developer carrying member; wherein;

the carrier comprises carrier particles, and each carrier particle comprises a carrier core and a silicone resin coat layer that covers the carrier core;

the carrier particle has silicon atoms and carbon atoms on its surface in the ratio that satisfies the condition of:

Si/C=0.1 to 2.0 as the number of atoms present on the carrier particle surface as measured by XPS; and from 0.1% by number to 5% by number of metal atoms are present on the carrier particle surface.

DESCRIPTION OF THE PREFERRED EMBODIMENTS

Figure 1:
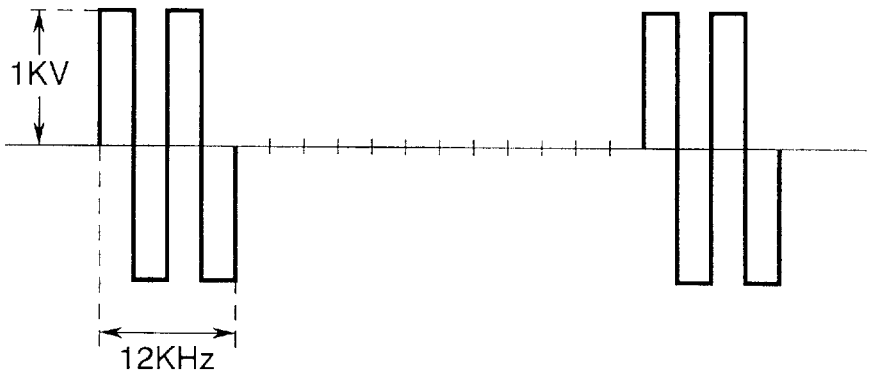
FIG. 1 shows a pattern of an alternating electric field used in Examples and Comparative Examples of the present invention.

The present inventors have discovered that, in use of a carrier having carrier particles each comprising a carrier core and a silicone resin coat layer that covers the carrier core, the ratio of the number of silicon atoms and carbon atoms present on the carrier particle surface and the percentage in which metal atoms are present on the carrier particle surface are decisively important.

The reason therefor is first that the presence of silicon atoms in a large quantity on the carrier particle surface makes the rise of charging of toner slow. This is presumably because silicon compounds have so small a surface energy that it becomes hard for the carrier to take up the toner, resulting in a slow rise of charging. If on the other hand carbon atoms are present in a large quantity, titanium oxide particles may adhere to the carrier particle surfaces to cause a deterioration of the carrier.

Secondly, proper adjustment of the percentage in which metal atoms are present on the carrier particle surfaces makes it possible to prevent charge-up of the carrier. It, however, is necessary to appropriately design the percentage taking account of its relation to coating materials.

Thus, the optimum designing of the ratio of silicon atoms and carbon atoms on the carrier particle surface and the percentage in which metal atoms are present on the carrier particle surfaces makes it possible to simultaneously satisfy the requirements of prevention of carrier contamination, stable charge-providing performance in all environments, and good charge rise performance.

The ratio of silicon atoms to carbon atoms may preferably satisfy the condition of:

Si/C=0.1 to 2.0 and more preferably satisfy the condition of:

Si/C=0.1 to 0.7.

If the Si/C is smaller than 0.1, titanium oxide tends to adhere to particle surfaces, and if it is more than 2.0, the rise of charging may become poor.

The metal atoms may preferably be present in an amount of 0.1 to 5% by number on the carrier particle surface. If the presence of the metal atoms is in an amount smaller than 0.1% by number, the charge-up may occur especially in an environment of low humidity. If it is in an amount more than 5% by number, the leak of charges may occur in an environment of high humidity.

The silicone resin used in the coat layer of the carrier of the present invention may more preferably contain an aminosilane coupling agent (i.e., a cross-linkable silicone resin) since the rise of charging can be improved, sufficient charges can be imparted to the toner and also the separation of coat layers may hardly occur.

The reason therefor is firstly that, because it has amino groups, the silicone resin has a great ability to provide negative charges to negatively chargeable color toners, and can provide sufficient charges also to a toner making use of fine titanium oxide particles of the present invention, which have almost neutral chargeability. Secondly, the resin coat layer assumes a network structure as a result of coupling reaction, it has a high resistance to physical impact to cause no separation of coat layers.

The aminosilane coupling agent that can be used in the present invention may include agents represented by the formula:

$$R_m Si—Y_n$$

wherein R represents an alkoxyl group, Y represents a hydrocarbon group containing an amino group, m represents an integer of 1 to 3, and n represents an integer of 3 to 1.

For example, agents shown below as specific exemplary compounds (1) to (14) may be used.

$$NH_2CH_2CH_2CH_2Si(OCH_3)_3 \quad (1)$$

$$NH_2CH_2CH_2CH_2Si(OC_2H_5)_3 \quad (2)$$

$$NH_2CH_2CH_2CH_2\overset{\overset{CH_3}{|}}{Si}(OCH_3)_2 \quad (3)$$

$$NH_3CONHCH_2CH_2CH_2Si(OC_2H_5)_3 \quad (4)$$

$$NH_2CH_2CH_2NHCH_2CH_2CH_2Si(OCH_3)_3 \quad (5)$$

$$NH_2CH_2CH_2NHCH_2CH_2NHCH_2CH_2CH_2Si(OCH_3)_3 \quad (6)$$

$$(C_2H_5)_2NCH_2CH_2CH_2Si(OCH_3)_3 \quad (7)$$

$$(C_4H_9)_2NCH_2CH_2CH_2Si(OCH_3)_3 \quad (8)$$

$$CH_3OCOCH_2CH_2NHCH_2CH_2NHCH_2CH_2CH_2Si(OCH_3)_3 \quad (9)$$

$$C_6H_5-NCH_2CH_2CH_2Si(OCH_3)_3 \quad (10)$$

$$CH_3CH_2NHCH_2CH_2CH_2Si(OCH_3)_3 \quad (11)$$

$$CH_3CH_2CH_2CH_2NHCH_2CH_2CH_2Si(OCH_3)_3 \quad (12)$$

$$NH_2CH_2CH_2NHCH_2CH_2\overset{\overset{CH_3}{|}}{C}H_2Si(OCH_3)_2 \quad (13)$$

$$NH_2-C_6H_4-Si(OCH_3)_3 \quad (14)$$

These may be used alone or in combination of two or more kinds.

Of these, those preferably usable in the present invention in view of compatibility, reactivity and stability are the following coupling agents having at least one nitrogen atom having one hydrogen atom.

$$NH_3CONHCH_2CH_2CH_2Si(OC_2H_5)_3 \quad (4)$$

$$NH_2CH_2CH_2NHCH_2CH_2CH_2Si(OCH_3)_3 \quad (5)$$

$$NH_2CH_2CH_2NHCH_2CH_2NHCH_2CH_2CH_2Si(OCH_3)_3 \quad (6)$$

$$CH_2OCOCH_2CH_2NHCH_2CH_2NHCH_2CH_2CH_2Si(OCH_3)_3 \quad (9)$$

$$C_6H_5-NHCH_2CH_2CH_2Si(OCH_3)_3 \quad (10)$$

$$CH_3CH_2NHCH_2CH_2CH_2Si(OCH_3)_3 \quad (11)$$

$$CH_3CH_2CH_2CH_2NHCH_2CH_2CH_2Si(OCH_3)_3 \quad (12)$$

$$NH_2CH_2CH_2NHCH_2CH_2\overset{\overset{CH_3}{|}}{C}H_2Si(OCH_3)_2 \quad (13)$$

Aminosilane coupling agents in which the alkoxyl groups in the foregoing compounds are each replaced by a chlorine atom may also be used. Two or more coupling agents may also be used in combination.

In the present invention, the aminosilane coupling agent may preferably be added in an amount of from 0.1 to 8 parts by weight, and more preferably from 0.3 to 5 parts by weight, based on 100 parts by weight of siloxane solid content. Its addition in an amount less than 0.1 part by weight can bring about no enough effect of addition to cause a deterioration of charging performance and a decrease in coat strength, and its addition in an amount more than 8 parts by weight may enable no satisfactory reaction to rather cause a decrease in coat strength.

In the present invention, the coupling agent may be used further in combination with a coupling agent represented by the formula:

$$R_{4-a}—Si—Xa$$

wherein $R_{4-a}$ represents a vinyl group, a methacrylic group, an epoxy group, an amino group, a mercapto group or a derivative of any of these; a is 3; and X represents a halogen atom or an alkoxyl group.

Such a coupling agent may include those shown below as specific exemplary compounds (15) to (17).

$$CH_3=CH—Si—(OCH_3)_3 \quad (15)$$

$$CH_3—Si—(OCH_3)_3 \quad (16)$$

$$CH_3—Si—(OC_2H_5)_3 \quad (17)$$

In order to make the present invention more effective, it is preferable to use at least an oxime type hardening agent represented by the following formula, as a hardening agent for cross-linked silicone resin.

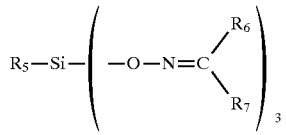

wherein $R_5$ represents a substituent selected from $CH_3$, $C_2H_5$,

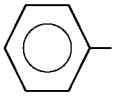

and derivatives thereof; and $R_6$ and $R_7$ each represent a substituent selected from $CH_3$, $C_2H_5$ and derivatives thereof. More specifically, the oxime type silane coupling agent is very advantageous in view of proper controllability of SiOH groups remaining in the silicone resin, storage stability, and cost.

The hardening agent in the present invention can be exemplified by those shown below as specific exemplary compounds (18) to (21).

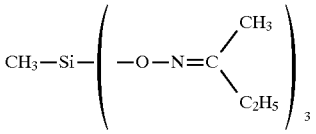

(18)

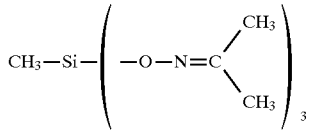

(19)

-continued

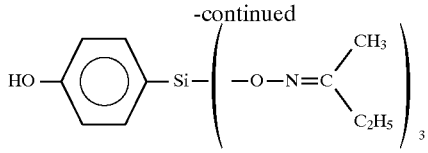

(20)

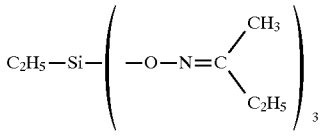

(21)

In the present invention, the oxime type hardening agent may be added in an amount of from 0.1 to 10 parts by weight, and preferably from 0.5 to 5 parts by weight, based on 100 parts by weight of siloxane solid content. Its addition in an amount less than 0.1 part by weight can bring about no enough effect of cross-linking, and its addition in an amount more than 10 parts by weight may enable no well removal of residues or may cause remains of incompletely reacted compounds, resulting in a lowering of charging performance and strength.

In the present invention, the aminosilane coupling agent described above may be incorporated into a known silicone resin when used. For example, silicone resins comprised of an organosiloxane bond such as dimethylsiloxane, or silicone resins modified with various modifying components such as epoxy-modified, amino-modified, carboxyl-modified, alkyl-modified or acryl-modified silicone resins may be used.

The surfaces of carrier cores can be coated with the silicone resin containing the aminosilane coupling agent, by a method in which the coating resin is dissolved or suspended in a solvent and the resulting solution or suspension is coated to cause the resin to adhere to the carrier particle surface, or by a method in which it is merely mixed in the form of powder. Either method may be employed.

In the present invention, the carrier may preferably have a weight average particle diameter of from 10 to 100 $\mu$m, more preferably from 25 to 65 $\mu$m, and still more preferably from 30 to 65 $\mu$m, in view of improvements in toner blend performance and toner transport performance. It is also preferable for the carrier to contain, in its weight distribution, 1 to 40% by weight of carrier particles with particle diameters of not smaller than 26 $\mu$m to smaller than 35 $\mu$m, 5 to 40% by weight of carrier particles with particle diameters of not smaller than 35 $\mu$m to smaller than 43 $\mu$m and not more than 2% by weight of carrier particles with particle diameters of not smaller than 74 $\mu$m, whereby good images can be maintained.

More preferably, the carrier may contain, in its weight distribution, 2 to 33% by weight of carrier particles with particle diameters of not smaller than 26 $\mu$m and smaller than 35 $\mu$m, 8 to 35% by weight of carrier particles with particle diameters of not smaller than 35 $\mu$m to smaller than 43 $\mu$m and 0 to 1.0% by weight of carrier particles with particle diameters of not smaller than 74 $\mu$m.

In the present invention, in order to obtain good multicolor images, sharp-melt color resin particles may preferably be used. In reverse, such color resin particles very tend to melt-adhere to the surface of a latent image bearing member.

Once the color resin particles have melt-adhered to the surface of a latent image bearing member, charges accumulate on the latent image bearing member, so that, with regard to development bias potential $V_{DC}$ and latent image dark potential $V_D$, $|V_{DC}-V_D|$ may become larger than 200 V. When it occurs, carrier particles not larger than 35 $\mu$m come to adhere to the surface of the latent image bearing member, so that they become effective to scrape off the matter melt-adhered to the surface of the latent image bearing member and faulty images can be prevented.

At this time, if the content of the carrier particles with particle diameters of not smaller than 26 $\mu$m to smaller than 35 $\mu$m is more than 40% by weight, the carrier particles may come to adhere also to the portion where $|V_{DC}-V_D|$ is smaller than 200 V, so that troubles such as faulty images and drum surface scrape tend to occur.

If on the other hand the content of the carrier particles with particle diameters of not smaller than 26 $\mu$m to smaller than 35 $\mu$m is less than 1% by weight, the carrier tends to have an unsatisfactory abrasion effect and tends to become no effective to scrape off the matter melt-adhered to the surface of the latent image bearing member and faulty images can not be prevented.

The carrier of the present invention may preferably have a value of electric current of from 20 to 150 $\mu$A, and preferably from 30 to 140 $\mu$A, when a voltage of 500 V is applied. If it is less than 20 $\mu$A, the charges on the carrier particle surfaces may have their escape cut off, so that the charges may accumulate on the carrier particle surface to make it hard for the toner to separate, resulting in a lowering of developing performance. If it is more than 150 $\mu$A, the carrier may have so small a charge retension that the charge quantity may decrease after the developer has been left to stand especially in an environment of high humidity.

As to materials for magnetic particles used for the cores of the carrier of the present invention, there are no particular limitations thereon, and it is possible to use iron oxide powders, particles of metals such as copper, manganese, cobalt, nickel, zinc, tin, magnesium, lead, strontium, barium and lithium, alloys or oxides of these, ferrites containing at least one of these, and particles comprised of a mixture of various types of resins and magnetic powders, having various forms such as flat, spongy, coin, round and truely spherical forms.

In order to improve adhesion to carrier cores, it is proposed to use a modified silicone resin. Modified silicone resins such as alkyd-modified, epoxy-modified, acryl-modified, polyester-modified, phenol-modified, melamine-modified or urethane-modified silicone resins may be used.

In order to improve the adhesion while a low surface energy is kept, it is proposed to use various types of additives in combination (Japanese Patent Application Laid-open No. 2-33159).

Such additives react with the silicone resin or with themselves to impart not only adhesion but also toughness. However, what is disclosed in Japanese Patent Application Laid-open No. 2-33159 is an alkoxysilane, which has a low reactivity for a coupling agent, and can not achieve a high toughness because of an unsatisfactory effect.

When the alkoxysilane is used in a large amount, it tends, because of a low reactivity, to remain in the coat layers as it is liquid, resulting in a more lowering of the toughness of coat layers.

As a silane coupling agent having a high reactivity, silane coupling agents having an eliminable group of an oxime type (oxysilane), an acetone type (propenoxysilane) or an acetic acid type (acetoxysilane) are known in the art. In particular, the oxime type silane coupling agents can be said to be materials preferable in view of storage stability and cost, as disclosed in Japanese Patent Application Laid-open No. 2-33159.

However, according to studies made by the present inventors, it is true that adhesion and toughness increase and mechanical durability improves when carrier particles are coated with silicone resin together with the oxime type silane coupling agent, but the charging performance in an environment of high humidity becomes low inversely. This is presumably because the eliminable group oxime of the silane coupling agent has so high a boiling point that it tends to remain in the coat layers, resulting in a decrease in hydrophobicity.

Now, extensive studies made by the present inventors have revealed that a carrier coated with a silicone resin having a certain degree of flexibility, in which an alkoxysilane (particularly preferably a hydrophobic alkylalkoxysilane) that is hard to remain in coat layers because its eliminable group alcohol tends to volatilize is used in combination, can exhibit superior performance in respect of not only mechanical durability but also charging performance in an environment of high humidity.

Thus, the silicone resin coat layers used in the present invention may preferably be formed using a resin composition containing i) a silicone resin comprised of an aggregate of segments represented by the following Formulas (I) to (III) and ii) compounds represented by the following Formulas (IV) and (V).

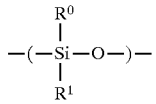
(I)

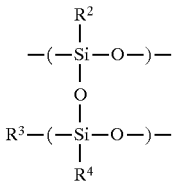
(II)

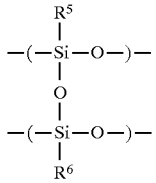
(III)

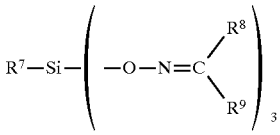
(IV)

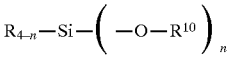
(V)

wherein $R^0$ to $R^{10}$ each represent a hydrocarbon group selected from a methyl group, an ethyl group, a phenyl group and a vinyl group; R represents a hydrocarbon group which may be substituted with an electron-donative group; and n represents an integer of 1 to 3.

The above segments (I) to (III) may preferably be in the ratio that satisfies the condition of:

(I)/(II+III)=1/99 to 60/40 and (II)/(III)=10/90 to 100/0 and more preferably in the ratio that satisfies the condition of:

(I)/(II+III)=2/88 to 50/50 and (II)/(III)=30/70 to 100/0

If (I)/(II+III)<1/99 or (II)/(III)<10/90, the alcohol and oxime having been released tend to remain in the polymer because of a low flexibility or elasticity of the polymer, so that no preferable charging performance can be obtained, or the coat layers may become brittle to tend to cause a break. If on the other hand (I)/(II+III)>60/40, straight-chain components are so many that the toughness may become low to make it difficult to obtain a preferable durability.

In the present invention, to the silicone resin containing the segments represented by Formulas (I) to (III), the compounds represented by Formulas (IV) and (V) may each preferably be added in an amount of from 0.1 to 10 parts by weight, and more preferably from 0.5 to 8 parts by weight, and as the sum total of compounds (IV) and (V), preferably in an amount of from 0.5 to 20 parts by weight, and more preferably from 0.5 to 15 parts by weight, whereby the carrier having the performances previously stated can be obtained. If the content of the compounds (IV) and (V) is less than 0.1 part by weight, no satisfactory effect can be obtained. If it is more than 10 parts by weight, the released oxime or unreacted compound (V) tend to remain to cause a lowering of charging performance and toughness.

The oxysilane (IV) and alkoxysilane (V) used in the present invention may specifically include those shown below as specific exemplary compounds (22), (23), and (24), to (26), Examples are by no means limited to these.

Oxysilane

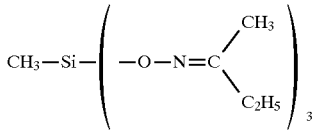
(22)

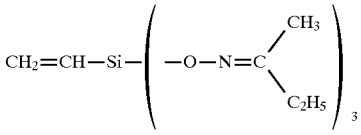
(23)

Alkoxysilane

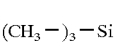
(24)

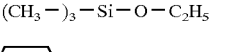
(25)

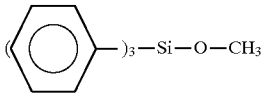
(26)

It has been also revealed that the carrier coated with the coating material of the present invention exhibits a superior charging performance especially when it has a small particle diameter. This is presumably because the surface area of the carrier commonly increases with a decrease in carrier particle diameter, so that the quantity of adsorbed water present on the particle surfaces also increases, and hence the hydrolysis at the part of functional groups pertaining to cross-linking is accelerated to improve coating properties of the silicone resin on the carrier core surfaces.

However, when the carrier has a too small particle diameter, the fluidity of the developer may become low, resulting in a lowering of fine-line reproduction or a slow rise of charging.

For such a proper particle size, the carrier may have a weight average particle diameter of from 25 to 65 $\mu$m. If it is smaller than the size of this range, the fluidity required for developers may become lower, and if it is too large, the durability of charging performance may become lower especially in an environment of high humidity.

In the present invention, when the carrier cores are coated using the resin composition containing i) the silicone resin comprised of an aggregate of segments represented by Formulas (I) to (III) and ii) the compounds represented by Formulas (IV) and (V), the coating weight of the resin that forms the coat layers, based on the weight of the carrier cores, may preferably be in the range of from 0.01% by weight to 10% by weight, and more preferably from 0.1% by weight to 5% by weight, in terms of resin solid content. If it is less than 0.05% by weight, the coating of carrier cores with resin can not be well effective. A coating weight of more than 10% by weight is meaningless, and is not preferable from the viewpoint of manufacture because excess resin may become present alone.

To coat the carrier cores with the resin, it is possible to use a method in which the carrier cores are immersed in a solution obtained by dissolving in a suitable solvent the resin composition comprised of the components represented by Formulas (I) to (V), followed by desolvation, drying and high-temperature baking, or a method in which the cores are floated in a fluidized bed, and the copolymer solution is spray-coated, followed by drying and high-temperature baking.

The coating weight of the silicone resin may also preferably satisfy the following relation, when coating weight based on 100 g of carrier cores is represented by a g, and specific surface area of the carrier particles formed after the coating is represented by S $cm^2/g$:

$$(a/S)\times10^4=2 \text{ to } 30$$

where a is 0.01 to 1.0;

and more preferably satisfy the following relation:

$$(a/S)\times10^4=5 \text{ to } 20$$

where a is 0.01 to 1.0.

Under such relation of coating weight, residues formed during the coupling reaction can be removed with ease when the resin is hardened on the carrier particle surfaces, so that the carrier can exhibit very good performances including durability and charging performance.

In order to make the present invention more effective, a may preferably be 0.02 to 0.8, and more preferably 0.05 to 0.5.

The carrier may also preferably have a specific surface area of from 280 to 600 $cm^2/g$, and more preferably from 300 to 560 $cm^2/g$. This is particularly preferred in order to satisfy the foregoing relation between the coating weight and the specific surface area of the carrier.

As previously described, the carrier cores can be coated with the resin by a method in which the carrier cores are immersed in a solution obtained by dissolving the resin composition in a suitable solvent, followed by desolvation, drying and high-temperature baking, or a method in which the cores are floated in a fluidized bed, and the copolymer solution is spray-coated, followed by drying and high-temperature baking.

The carrier of the present invention, thus obtained, is blended with a toner and the resulting blend is used as the two-component type developer, i.e., a magnetic brush developer for developing electrostatic latent images.

The two-component type developer of the present invention will be described below.

In the two-component type developer of the present invention, any toners usually used in electrophotography, comprised of a binder resin and a colorant dispersed therein, may be used without any particular limitations.

When the two-component type developer is prepared by blending the carrier according to the present invention with a toner, they may be blended in such a proportion that the toner in the developer is in a concentration of from 1.0% by weight to 12% by weight, and preferably from 2% by weight and 9% by weight, whereby good results can usually be obtained. If the toner concentration is less than 1.0% by weight, image density may become too low to be practically usable. If it is more than 12% by weight, fog or in-machine toner scatter may greatly occur to shorten the lifetime of the developer.

In the present invention, when the toner is used as a color toner, the colorant used therein may include known dyes and pigments as exemplified by Phthalocyanine Blue, Indanthrene Blue, Peacock Blue, Permanent Red, Lake Red, Rhodamine Lake, Hanza Yellow, Permanent Yellow and Benzidine Yellow, any of which can be widely used. The colorant may be contained in an amount of not more than 12 parts by weight, and more preferably from 0.5 to 9 parts by weight, based on 100 parts by weight of the binder resin, taking account of a sensitive reflection to light transmission properties of OHP films.

In the toner according to the present invention, a charge control agent may be mixed so that their charge performance can be stabilized. In that instance, it is preferred to use a colorless or pale-colored charge control agent that does not affect the color tone of the toner. The charge control agent that can be used in the present invention may include amino compounds, quaternary ammonium compounds and organic dyes, in particular, basic dyes and salts thereof, Nigrosine bases and salicylic acid chelate compounds. Of these, it is particularly preferable to use a negative charge control agent which may include organic metal complexes as exemplified by a metal complex of alkyl-substituted salicylic acid, e.g., a chromium complex or zinc complex of di-tert-butylsalicylic acid. In the case when the charge control agent is mixed in the toner, it should be added in an amount of from 0.1 to 10 parts by weight, and preferably from 0.5 to 8 parts by weight, based on 100 parts by weight of the binder resin.

To the toner of the present invention, additives may be optionally added so long as the properties of the toner are not damaged. Such additives can be exemplified by a lubricant such as Teflon, zinc stearate or polyvinylidene fluoride, and a fixing auxiliary as exemplified by low-molecular weight polyethylene or low-molecular weight polypropylene.

In preparing the toner of the present invention, it is possible to apply a method in which toner component materials are well kneaded by means of a heat-kneading machine such as a heat roll, a kneader or an extruder, thereafter the kneaded product is pulverized by a mechanical means, and then the pulverized powder is classified to give a toner; a method in which toner component materials such as colorants are dispersed in a binder resin solution, followed by spray drying to give a toner; or a method of preparing a toner by suspension polymerization, comprising mixing given materials with binder resin constituent polymerizable monomers, and subjecting an emulsion suspension of the resulting mixture to polymerization; as well as other known toner preparation methods.

As binder materials used in colorant-containing particles (the toner), various types of material resins conventionally known as toner binder resins for electrophotography may be used.

For example, usable ones are homopolymers of styrene or derivatives thereof such as polystyrene poly-p-chlorostyrene and polyvinyltoluene; styrene copolymers such as a styrene-p-chlorostyrene copolymer, a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-methyl methacrylate copolymer, a styrene-ethyl methacrylate copolymer, a styrene-butyl methacrylate copolymer, a styrene-methyl α-chloromethacrylate copolymer, a styrene-acrylonitrile copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-acrylonitrileindene copolymer, a styrene-maleic acid copolymer and a styrene-maleate copolymer; polymethyl methacrylate, polybutyl methacrylate, polyvinyl chloride, polyvinyl acetate, polyethylene, polypropylene, polyester, polyurethane, polyamide, epoxy resins, polyvinyl butyral, polyamide, polyacrylic acid resins, rosin, modified rosins, terpene resins, phenol resins, aliphatic or alicyclic hydrocarbon resins, aromatic petroleum resins, chlorinated paraffin, and paraffin wax, which may be used alone or in combination.

Of these resins, the effect of the present invention can be greatest particularly when polyester resins are used, which have a high negative chargeability. That is, the polyester resins can achieve excellent fixing performance and are suited for color toners, but on the other hand have so strong a negative chargeability that charges tend to become excessive. However, the use of polyester resins under the constitution of the present invention can be free of such difficulties and can bring about an excellent toner.

In particular, the following polyester resin is preferred because of its sharp melt properties, which is a polyester resin obtained by co-condensation polymerization of i) a diol component comprised of a bisphenol derivative or substituted bisphenol represented by the formula:

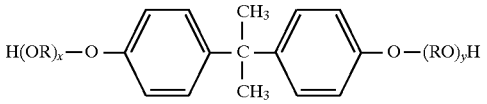

wherein R represents a styrene group or a propylene group, and x and y each represent an integer of 1 or more, where x+y is 2 to 10 on the average;

and ii) a carboxylic acid component comprising a dibasic or higher basic carboxylic acid or an acid anhydride or lower alkyl ester thereof, as exemplified by fumaric acid, maleic acid, maleic anhydride, phthalic acid, terephthalic acid, trimellitic acid and pyromellitic acid.

In the present invention, it is preferable to add an external additive to the toner. The external additive may preferably have an average particle diameter of not larger than 0.2 μm, more preferably from 0.002 to 0.2 μm, and still more preferably from 0.01 to 0.2 μm.

If the average particle diameter of the external additive is larger than 0.2 μm, the fluidity of the toner can be less effectively improved. Especially when it is 0.002 μm or larger, external additive particles may agglomerate with difficulty and the fluidity can be more effectively improved.

As the external additive, fluorine resin powders, aliphatic acid metal salts and metal oxides which are those commonly known as external additives may be used. Titanium oxide, silica and alumina are preferred.

In the present invention, the toner may contain at least fine titanium oxide particles as its external additive. This is preferable for more stabilizing charge.

Particularly preferably, fine particles of anatase type titanium oxide having been surface-treated while hydrolyzing a coupling agent in an aqueous system are very effective for stabilizing charge and providing fluidity. This could not be achieved by hydrophobic silica commonly known as a fluidity improver.

This is because, while the fine silica particles have a strong negative chargeability in themselves, the fine titanium oxide particles have substantially a neutral chargeability. It has been hitherto proposed to add hydrophobic titanium oxide. However, the fine titanium oxide particles have originally a smaller surface activity than silica, and have not necessarily been made well hydrophobic. Although hydrophobicity may increase when a treating agent is used in a large quantity or a highly viscous treating agent is used, the particles may coalesce one another or the fluidity-providing performance may decrease. Thus, both the stabilization of charge and the providing of fluidity have not necessarily been achieved at the same time.

Meanwhile, hydrophobic silica certainly has a good fluidity-providing performance, but may inversely cause electrostatic agglomeration because of its strong chargeability when contained in a large quantity, resulting in a lowering of the fluidity-providing performance. In this regard, the titanium oxide can greatly improve the fluidity of toner with its increase in quantity.

Use of anatase type titanium oxide is disclosed in, for example, Japanese Patent Application Laid-open No. 60-112052. The anatase type titanium oxide, however, has a volume resistivity of as small as about $10^7$ Ω·cm, and hence its use as it is may cause a quick leak of charges especially in an environment of high humidity. Thus, it can not necessarily be satisfactory in view of charge stabilization, and has been sought to be improved.

As an example of incorporating hydrophobic titanium oxide into a toner, Japanese Patent Application Laid-open No. 59-52255 also discloses a toner containing titanium oxide treated with an alkyltrialkoxysilane. Although the addition of titanium oxide has certainly brought about an improvement in electrophotographic performances, the titanium oxide originally has so small a surface activity that coalescent particles may occur at the stage of treatment or it may have been made non-uniformly hydrophobic, and hence can not necessarily be satisfactory.

The present inventors made extensive studies on the stability of chargeability of toners. As a result, they have discovered that an anatase type titanium oxide having been treated while hydrolyzing a coupling agent in an aqueous system, having an average particle diameter of from 0.01 to 0.2 μm and a hydrophobicity of from 20 to 80%, enables homogeneous hydrophobic treatment and can be free of coalescence of particles, and discovered that a toner containing such a titanium oxide is very effective for stabilizing charges and providing fluidity.

More specifically, anatase type fine titanium oxide particles are surface-treated in an aqueous system while mechanically dispersing them so as to be formed into primary particles and while hydrolyzing a coupling agent. It has been found that such treatment makes it harder to cause the coalescence of particles than their treatment in a gaseous phase and also the treatment makes the particles mutually undergo static repulsion, so that the anatase type fine titanium oxide particles can be surface-treated substantially in the state of primary particles.

In order to apply a mechanical force so that the fine titanium oxide particles are dispersed to be formed into primary particles when the surfaces of titanium oxide particles are treated while hydrolyzing a coupling agent in an aqueous system, it is unnecessary to use coupling agents such as chlorosilanes or silazanes that may generate gas. It also becomes possible to use a highly viscous coupling agent that has not been usable because of coalescence of particles in a gaseous phase, so that the particles can be greatly effectively made hydrophobic.

The coupling agent that can be used in the surface treatment of the fine titanium oxide particles may include silane coupling agents and titanium coupling agents. Silane coupling agents are particularly preferably used, which are those represented by the formula:

$$R_mSiY_n$$

wherein R is an alkoxyl group; m is an integer of 1 to 3; Y is an alkyl group, or a hydrocarbon group containing a vinyl group, a glycidoxyl group or a methacrylic group; and n is an integer of 1 to 3.

Such silane coupling agents may include, for example, vinyltrimethoxysilane, vinyltriethoxysilane, γ-methacryloxypropyltrimethoxy-silane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane and n-octadecyltrimethoxysilane.

Of these coupling agents, compounds represented by the following formula are particularly preferred.

$$C_\alpha H_{2\alpha+1}—Si(OC_\beta H_{2\beta+1})_3$$

wherein α represents an integer of 4 to 12 and β represents an integer of 1 to 3.

Here, if α in the formula is smaller than 4, the treatment becomes easier but no satisfactory hydrophobicity can be achieved. If α is larger than 13, a satisfactory hydrophobicity can be achieved but the coalescence of titanium oxide particles may increase, resulting in a lowering of fluidity-providing performance. If β is larger than 3, the reactivity may become lower to make the particles insufficiently hydrophobic. Hence, in the present invention, α should be 4 to 12, and preferably 4 to 8, and β should be 1 to 3, and preferably 1 or 2.

In the present invention, in addition to the treatment with the coupling agent described above, a further treatment with silicone oil may be applied. Such a treatment improves transfer performance of the toner, and is more preferred. As a method therefor, in view of efficiency, the treatment may preferably be carried out in the same aqueous system.

The treatment with the coupling agent and the silicone oil may be carried out in an amount of from 1 to 50% by weight, and preferably from 3 to 40% by weight, based on the weight of titanium oxide, and may be made to give a hydrophobicity of from 20 to 80%, and preferably from 40 to 80%.

That is, if the hydrophobicity is less than 20%, charges may greatly decrease when the toner is left to stand for a long period of time in an environment of high humidity, so that a mechanism for charge acceleration becomes necessary on the side of hardware, resulting in a complicated apparatus. If the hydrophobicity is more than 80%, even the use of anatase type titanium oxide having a small volume resistivity makes it difficult to control the charging of titanium oxide itself, resulting in charge-up of the toner in an environment of low humidity.

In the present invention, in view of the fluidity-providing performance, the titanium oxide should have an average particle diameter of from 0.01 to 0.2 μm. If its average particle diameter is larger than 0.2 μm, the toner may be non-uniformly charged because of a poor fluidity, so that toner scatter and fog may occur. If its average particle diameter is smaller than 0.01 μm, the particles tend to be buried in toner particle surfaces to cause an early deterioration of the toner, resulting in a lowering of durability or running performance inversely. This more remarkably tends to occur in the case of a sharp-melting color toner used in the present invention.

In the present invention, the titanium oxide may be treated by a method in which it is treated in an aqueous system by hydrolyzing the coupling agent while the titanium oxide is mechanically dispersed to be formed into primary particles. This method is effective and is preferable also in view of the use of no solvent.

The titanium oxide treated in the manner as described above may preferably have a light transmittance of 40% or more at a light wavelength of 400 nm.

Namely, the titanium oxide used in the present invention has a primary particle diameter of as very small as 0.2 to 0.01 μm. When, however, actually incorporated into the toner, the titanium oxide is not necessarily dispersed in the form of primary particles, and may sometimes be present in the form of secondary particles. Hence, whatever the primary particle diameter is small, the above treatment may become less effective if the particles behaving as secondary particles has a large effective diameter. Nevertheless, titanium oxide having a higher light transmittance at 400 nm which is the minimum wavelength in the visible region has a correspondingly smaller secondary particle diameter. Thus, good effects can be expected for the fluidity-providing performance and the sharpness of projected images in OHP in the case of color toners. The reason why 400 nm is selected is that it is a wavelength at a boundary region between ultraviolet and visible, and also it is said that light passes through particles with a diameter not larger than ½ of light wavelength. In view of these, any transmittance at wavelengths beyond 400 nm becomes higher as a matter of course and is not so meaningful.

The present inventors have also ascertained by X-ray diffraction, that the titanium oxide has the crystal form of an anatase type in which lattice constant (a) is 3.78 Å and lattice constant (b) is 9.49 Å.

Meanwhile, as a method for obtaining hydrophobic fine titanium oxide particles, a method is also known in which a volatile titanium alkoxide or the like is oxidized at a low temperature to make it spherical, followed by surface treatment to obtain an amorphous spherical titanium oxide. This method, however, requires a high cost because of an expensive starting materials and a complicated production apparatus. Taking account of these points, this method is not superior to the present invention in view of cost.

The titanium oxide described above preferably reacts when used in combination with a toner having a weight average particle diameter of from 4 to 10 μm. That is, the surface area per weight increases as the toner particles are made to have a smaller particle diameter, tending to cause excessive charging due to rubbing friction. As a countermeasure for it, the fine titanium oxide particles capable of controlling charging and imparting fluidity are greatly effective. The titanium oxide preferably used in the present invention may be contained in an amount of from 0.5 to 5% by weight, and preferably from 0.7 to 3% by weight.

Use of the above fine titanium oxide particles as an external additive of the toner has made it possible to design toners having a high image quality and a superior environmental stability, but it has been also found that, when used in combination with conventional usual carriers, fine titanium oxide particles adhere to the carrier particle surfaces to tend to cause carrier contamination. Once the contamination occurs, the chargeability of the carrier becomes greatly low to cause fog and toner scatter adversely because of the substantial neutrality in the charging of the fine titanium oxide particles.

However, the combination of the toner making use of the above fine titanium oxide particles as an external additive with the above carrier of the present invention is effective for solving the above problems.

In the carrier according to the present invention, a best embodiment is, in particular, a carrier wherein i) the carrier core surfaces are coated with the cross-linkable silicone resin containing an aminosilane coupling agent, ii) each carrier particle has silicon atoms and carbon atoms on its surface in the ratio that satisfies the condition of:

$$Si/C=0.1 \text{ to } 2.0$$

as the number of atoms present on the carrier particle surface as measured by XPS, and iii) from 0.1% by number to 5% by number of metal atoms are present on the carrier particle surface.

Conventional carriers coated with silicone resin have a small surface energy, and have the advantage that the carrier may deteriorate with difficulty. Such silicone resin-coated carriers, however, compared with, e.g., acrylic resin-coated carriers, have a poor rise of charging, and the charging of toner slowly rises especially in an environment of low humidity to cause a decrease in image density with respect to that at the initial stage. In particular, this greatly tends to occur in the toner making use of the fine titanium oxide particles of the present invention. Carrier contamination may also occur depending on silicone resins used, as in the case of the acrylic resin-coated carriers. Hence, the silicone resin-coated carriers can not be said to be most favorable.

However, the use of the above carrier of the present invention in combination with the toner to which the fine titanium oxide particles have been externally added causes no deterioration of the carrier even when copies are taken on a large number of sheets and makes it possible to maintain images with a high quality achieved at the initial stage. Moreover, it becomes possible to attain good charging performance and good rise of charging in all environments.

The image forming method making use of the two-component type developer described above will be described below.

The image forming method of the present invention comprises rotationally transporting the two-component type developer carried onto a developer carrying member, and developing in a developing zone defined by a latent image bearing member and the developer carrying member provided opposingly thereto, a latent image beared on the latent image bearing member, using a toner of the two-component type developer carried on the developer carrying member.

Magnetic characteristics of carriers are affected by a magnet roller built in a developing sleeve, and greatly affect the developing performance and transport performance of developers.

In the present invention, of the developing sleeve (developer carrying member) and the magnet roller built therein, for example, the magnet roller is set stationary and the developing sleeve alone is rotated, where the two-component type developer comprised of a carrier comprising magnetic particles and an insulative color toner is rotationally transported onto the developing sleeve and an electrostatic latent image beared on the surface of a latent image bearing member is developed using the two-component type developer.

In the image forming method of the present invention, color copying can enjoy good image uniformity and gradation reproduction when (1) the magnet roller is comprised of five poles having a repulsion pole, (2) the magnetic flux density in the developing zone is 500 to 1,200 gauss and (3) the carrier has a saturation magnetization of 90 to 35 emu/g. Thus, such an embodiment is preferred.

If the carrier has a saturation magnetization of more than 90 emu/g (with respect to an applied magnetic field of 3,000 oersteds), brushlike ears formed of the carrier and the toner on a developing sleeve provided opposingly to the electrostatic latent image formed on a photosensitive member at the time of development may rise in a tight state to cause a poor gradation or half-tone reproduction. If it has a saturation magnetization of less than 35 emu/g, it may become difficult for the toner and carrier to be well carried on the developing sleeve, tending to cause the problem of carrier adhesion or serious toner scatter. If the carrier has excessively high residual magnetization and coercive force, the developer may be prohibited from being well transported through a developing assembly, tending to cause faulty images such as blurred images and density non-uniformity in solid images to make developability poor. Hence, in order to maintain the developing performance in color copying, different from usual black and white copying, it is important for the carrier to have a residual magnetization of 10 emu/g or less, preferably 5 emu/g or less, and more preferably substantially 0, and a coercive force of 40 oersteds or less (with respect to an applied magnetic field of 3,000 oersteds), preferably 30 oersteds or less, and more preferably 10 oersteds or less.

The image forming method of the present invention may also preferably comprise forming in the developing zone a developing electric field between the latent image bearing member and the developer carrying member by applying to the developer carrying member a first voltage for directing the toner from the latent image bearing member toward the developer carrying member, a second voltage for directing the toner from the developer carrying member toward the latent image bearing member and a third voltage intermediate between the first voltage and the second voltage, to develop a latent image beared on the latent image bearing member, using the toner of the two-component type developer carried on the developer carrying member.

In the foregoing, the time for which the third voltage intermediate between the first voltage and the second voltage is applied to the developer carrying member may be made longer than the time ($T_1$) for which the first voltage for directing the toner from the latent image bearing member toward the developer carrying member and the second voltage for directing the toner from the developer carrying member toward the latent image bearing member are applied to the developer carrying member. This is particularly preferred in order to rearrange the toner and reproduce images faithfully to latent images on the latent image bearing member.

Stated specifically, the image forming method may comprise forming in the developing zone, at least once between the latent image bearing member and the developer carrying member, an electric field in which the toner is directed from the latent image bearing member toward the developer carrying member and an electric field in which the toner is directed from the developer carrying member toward the latent image bearing member, and thereafter forming for a given time an electric field in which the toner is directed from the developer carrying member toward the latent image bearing member in an image area of the latent image bearing member and an electric field in which the toner is directed from the latent image bearing member toward the developer carrying member in a non-image area of the latent image bearing member, to develop a latent image beared on the latent image bearing member, using the toner of the two-component type developer carried on the developer carrying member, where the time for forming the electric field in which the toner is directed from the developer carrying member toward the latent image bearing member in an image area of the latent image bearing member and the electric field in which the toner is directed from the latent image bearing member toward the developer carrying member in a non-image area of the latent image bearing member may preferably be made longer than the total time ($T_1$) for forming the electric field in which the toner is directed from the latent image bearing member toward the developer carrying member and the electric field in which the toner is directed from the developer carrying member toward the latent image bearing member.

The carrier of the present invention has the specific average particle diameter and particle size distribution as previously described, and also the specific coating material has achieved a favorable improvement in the rise of triboelectric charging with the toner. In the meantime, one may concern oneself about the carrier adhesion to the surface of the latent image bearing member during development. However, the carrier adhesion may more hardly occur when development is carried out in the presence of a developing electric field where alternation is periodically made off in the developing process in which development is carried out while forming the above specific developing electric field, i.e., an alternating electric field. The reason therefor is still unclear, and is presumed as follows:

In conventional continuous sinusoidal or rectangular waves, when an electric field intensity is made higher in an attempt to achieve a higher image quality and density, toner and carrier join to reciprocate between a latent image bearing member and a developer carrying member, so that the carrier strongly rubs against the latent image bearing member to cause the carrier adhesion. This more remarkably tends to occur with an increase in the fine carrier powder.

However, the application of the specific developing electric field as in the present invention causes the toner or the carrier to reciprocate between the developer carrying member and the latent image bearing member in an incomplete reciprocation under one pulse. Hence, after that, in the case when a potential difference $V_{cont}$ between the surface potential of the latent image bearing member and the potential of a direct current component of a developing bias is $V_{cont}<0$, the direct current component acts in the manner that it causes the carrier to fly from the developer carrying member. However, the carrier adhesion can be prevented by controlling magnetic properties of the carrier and magnetic flux density in the developing zone of a magnet roller. In the case of $V_{cont}>0$, the force of a magnetic field and the direct current component act in the manner that they attract the carrier to the side of the developer carrying member, where no carrier adhesion occurs.

In order to make the present invention much more effective on the matter described above, the carrier may preferably be made to have an apparent density of from 1.8 to 3.2 g/cm$^3$. If its apparent density is lower than the above lower limit, the carrier adhesion may tend to occur. On the other hand, if its apparent density is higher than the above upper limit, not only the toner scatter may tend to occur but also the deterioration of images may be accelerated.

As described above, the application of the specific developing electric field as in the present invention has proved to be very effective for preventing the carrier adhesion, and at the same time is seen to be effective for all improvements in image density, decrease in fog, and improvement in highlight reproduction and fine-line reproduction.

The reason for the above is still unclear. Since the application of the specific developing electric field in the present invention is very effective in the above carrier and the above specific toner with a weight average particle diameter of 4 to 10 $\mu$m, the reason is presumed as follows:

The specific developing electric field of the present invention is applied at a very high frequency under one pulse. Hence, the toner has a large weight average particle diameter, e.g., larger than 10 $\mu$m, it can not faithfully follow up the developing electric field, inversely resulting in a lowering of the ability to develop latent images, to cause image deterioration such as black spots around fine lines or fog.

In order to make the toner faithfully follow up the specific developing electric field of the present invention, the charge quantity of toner on the carrier should be made uniform and also the toner and the carrier should be kept away form their strong adhesion. In the present invention, however, not only the silicone resin incorporated with the specific aminosilane coupling agent is used as a coating material of carrier cores for the purpose of improving the rise of charging of toner and making particle size distribution sharp, but also, in order to improve blend performance of carrier to toner and transport performance on the developer carrying member and to control and sharpen charge absolute values, the particle size distribution of the carrier is controlled within a preferable range so that the developing brush comes into soft contact with the surface of the latent image bearing member against the specific alternating electric filed of the present invention so as for developed images not to be disturbed by the developing brush. Thus, as so presumed, it has been accomplished to make the image quality higher.

As stated above, in order to make the toner faithfully follow up the specific developing electric field of the present invention, it is problematic for the toner to undergo charge-up to cause a strong electrostatic attraction to the carrier or a continual accumulation of charges on carrier particles. However, in the present invention, the amount of the carrier coating material is set a little small within the preferable range to positively cause the charges on the carrier to leak away. Because of the use of the hydrophobic fine titanium oxide particles having been uniformly surface-treated under specific conditions as in the present invention, the charges on the toner are well retained in an environment of high humidity and on the other hand, in an environment of low humidity, move in the direction in which the charges are cancelled. Hence, the developing performance of the toner on the carrier can be constantly controlled and the toner can faithfully follow up the developing electric field in all environments.

An image forming apparatus usable in the image forming method of the present invention will be described below with reference to FIG. 5.

Figure 5:
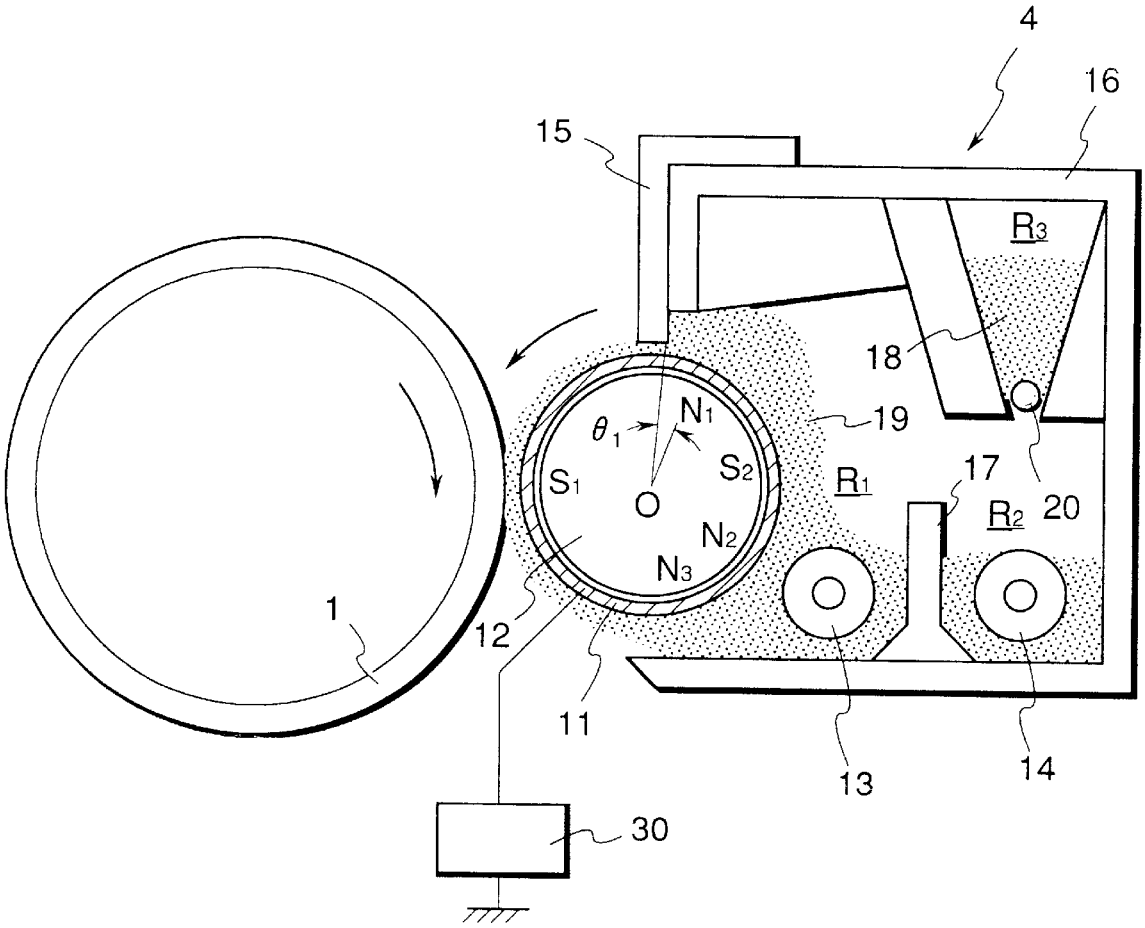
FIG. 5 schematically illustrates an image forming apparatus that can carry out the image forming method of the present invention.

As shown in FIG. 5, the image forming apparatus comprises a photosensitive drum 1 serving as the latent image bearing member, and a developing assembly 4 in which the inside of a developer container 16 is partitioned into a developing chamber (first chamber) R1 and an agitator chamber (second chamber) R2 by a partition wall 17. At the upper part of the agitator chamber R2, a toner storage chamber R3 is formed on the other side of the partition wall 17. A developer 19 is held in the developing chamber R1 and agitator chamber R2, and a replenishing toner (non-magnetic toner) 18 is held in the toner storage chamber R3. The toner storage chamber R3 is provided with a supply opening 20 so that the replenishing toner 18 is dropwise supplied through the supply opening 20 into the agitator chamber R2 in the quantity corresponding to the toner consumed.

A transport screw 13 is provided in the developing chamber R1. As the transport screw 13 is rotatingly driven, the developer 19 held in the developing chamber R1 is transported in the longitudinal direction of a developing sleeve 11. Similarly, a transport screw 14 is provided in the agitator chamber R2 and, as a transport screw 14 is rotated, the toner having dropped from the supply opening 20 into the agitator chamber R2 is transported in the longitudinal direction of the developing sleeve 11.

The developer 19 is a two-component type developer comprising a non-magnetic toner and a magnetic carrier.

The developer container 16 is provided with an opening at its part adjacent to the photosensitive drum 1, and the developing sleeve 11 protrudes outward from the opening, where a gap is formed between the developing sleeve 11 and the photosensitive drum 1. The developing sleeve 11, formed of a non-magnetic material is provided with a bias applying means 30 for applying a bias voltage.

The magnet roller serving as a magnetic field generating means fixed inside the developing sleeve 11, that is, a magnet 12 has a developing magnetic pole S1, a magnetic pole N3 positioned at its downstream, and magnetic poles N2, S2 and N1 for transporting the developer 19. The magnet 12 is provided in the developing sleeve 11 in such a way that the developing magnetic pole S1 faces the photosensitive drum 1. The developing magnetic pole S1 forms a magnetic field in the vicinity of a developing zone defined between the developing sleeve 11 and the photosensitive drum 1, where a magnetic brush is formed by the magnetic field.

A developer regulating blade 15 provided above the developing sleeve 11 to control the layer thickness of the developer 19 on the developing sleeve 11 is a non-magnetic blade 15 made of a non-magnetic material such as aluminum or SUS 316 stainless steel, and the distance between its end and the face of the developing sleeve 11 is 300 to 1,000 $\mu$m, and preferably 400 to 900 $\mu$m. If this distance is smaller than 300 $\mu$m, the magnetic carrier may be caught between them to tend to make the developing layer uneven, and at the same time the developer necessary for carrying out good development can not be coated on the sleeve, bringing about the problem that only developed images with a low density and much uneveness can be obtained. In order to prevent uneven coating (what is called the blade clog) due to unauthorized particles included in the developer, the distance may preferably be 400 $\mu$m or larger. If it is more than 1,000 $\mu$m, the quantity of the developer coated on the developing sleeve 11 increases to enable no desired regulation of the developer layer thickness, bringing about the problems that the magnetic carrier particles adhere to the photosensitive drum 1 in a large quantity and also the circulation of the developer and the control of the developer by the non-magnetic blade 15 may become ineffective to tend to cause fog because of a shortage of triboelectricity of the toner.

The angle $\theta 1$ is $-5°$ to $35°$, and preferably $0°$ to $25°$. In the case of $\theta 1<-5°$, the developer thin layer formed by the magnetic force, reflection force, cohesive force and so forth that act on the developer may become sparse and much uneven. In the case of $\theta 1>35°$, the use of the non-magnetic blade causes an increase in the quantity of developer coating to make it difficult to obtain the desired quantity of developer.

This layer of magnetic carrier particles, even when the developing sleeve 11 is rotatingly driven in the direction of an arrow, moves slower as it separates from the sleeve surface in accordance with the balance between the binding force exerted by magnetic force and gravity and the transport force acting toward the transport of the sleeve 11. Of course, some particles drop by the effect of gravity.

Accordingly, the position to arrange the magnetic poles N1 and N3 and the fluidity and magnetic properties of the magnetic carrier particles may be appropriately selected, so that the magnetic carrier particle layer is transported toward the magnetic pole N1 as it stands nearer to the sleeve, to form a moving layer. Along this movement of the magnetic carrier particles, the developer is transported to the developing zone as the developing sleeve 11 is rotated, and participates in development.

Measuring methods used in the present invention will be described below.

(1) Measurement of the number of atoms on carrier particle surfaces by XPS (X-ray photoelectron spectroscopy):

As an XPS measuring device, an X-ray photoelectron spectroscope ESCALAB MODEL 200-X, manufactured by VG Corp is used. Measurement is made under the following conditions.

X-ray source: Mg K$\alpha$ (300 W)

Analysis region: 2×3 mm (2) Measurement of transmittance:

1. Sample 0.10 g

Alkyd resin 13.20 g (BECKOZOLE 1323-60-EL, available from Dainippon Ink & Chemicals, Incorporated)

Melamine resin 3.30 g (SUPER BECKAMINE J-820-60, available from Dainippon Ink & Chemicals, Incorporated)

Thinner 3.50 g (ALAMICK THINNER, available from Kansai Paint Co., Ltd.)

Glass media 50.00 g

Materials with the above composition are collected in a 150 cc glass bottle, and dispersion is carried out for 1 hour using a paint conditioner manufactured by Red Devil Co.

2. After the dispersion has been completed, the dispersed product is coated on a PTP film by means of a 2 mil. doctor blade.

3. The coating formed in the step 2. is heated at 120° C. for 10 minutes to carry out baking.

4. The sheet obtained in the step 3. is set on U-BEST, manufacture by Nihon Bunkou Co., to measure its transmittance in the range of 320 to 800 nm and make comparison.

(3) Measurement of weight average particle size distribution of carrier:

1. About 100 g of a sample is weighed to a precision of 0.1 g.
2. As sieves, 100 mesh to 400 mesh standard sieves (hereinafter "sieve(s)") are used and are overlaid one another in its frame in order of 100 mesh, 145 mesh, 200 mesh, 250 mesh, 350 mesh and 400 mesh so that the 100 mesh sieve is uppermost. A dish is placed at the bottom. The sample is placed on the uppermost sieve, which is then covered.
3. The sample is sieved using a vibrator for 15 minutes at a horizontal swing number of 285±6 per minute and a vibration number of 150±10 per minute.
4. After the sieving, carrier on each sieve and the dish is weighed to a precision of 0.1 g.

5. Size is calculated to two decimals in weight percentage, and calculations are found up to one decimal according to JIS-Z8401.
6. The sample 50 g is weighed to a precision of 0.1 g, and is put on a 500 mesh sieve, which is then sucked off from the bottom. From the weight loss, the weight of particles of 500 mesh-pass or smaller is calculated, and the weight of particles of 400 to 500 mesh-pass is calculated by subtracting the weight of particles of 500 mesh-pass or smaller from the weight of particles of 400 mesh-pass or smaller.

The frame of the sieves is 200 mm in diameter at the upper portion from the sieve surface and 45 mm in depth from the top to the sieve surface.

The average particle diameter is calculated according to the following equation, on the basis of the above measured values of particle size distribution.

Average particle diameter (μm) =
1/100 ×
{(weight of sample remaining on 100 mesh sieve) × 14 +
(weight of sample remaining on 145 mesh sieve) × 122 +
(weight of sample remaining on 200 mesh sieve) × 90 +
(weight of sample remaining on 250 mesh sieve) × 68 +
(weight of sample remaining on 350 mesh sieve) × 52 +
(weight of sample remaining on 400 mesh sieve) × 38 +
(weight of sample remaining on 500 mesh sieve) × 26 +
(weight of sample of 500 mesh-pass or smaller) × 17}

(4) Measurement of electrical current value of carrier:

1. 800 g of carrier is weighed and then exposed to environment for 15 minutes or longer. (Indoor temperature: 22°–25° C.; humidity: 50–54%)
2. A device comprising i) a conductive sleeve having a built-in magnet roll and provided with an ear-length regulating blade and ii) an opposing electrode provided opposingly to the sleeve at a distance of 1 mm is prepared.
3. Carrier is magnetically attracted to the gap between the sleeve and the opposing electrode.
4. The magnet roll in the sleeve is rotated to bring it into contact with the opposing electrode, and a DC current of 500 V is applied across the sleeve and the opposing electrode, where voltage drops at both ends of resistance of 1 MΩ and 10 kΩ are measured, and the electrical current value is calculated from the measurements.

(5) Measurement of particle size of toner:

The particle size distribution can be measured by various methods. In the present invention, it is measured using a Coulter counter.

A Coulter counter Model TA-II (manufactured by Coulter Electronics, Inc.) is used as a measuring device. An interface (manufactured by Nikkaki k.k.) that outputs number average distribution and volume distribution and a personal computer CX-1 (manufactured by Canon Inc.) are connected. As an electrolytic solution, an aqueous 1% NaCl solution is prepared using first-grade sodium chloride. Measurement is carried out by adding as a dispersant from 0.1 to 5 ml of a surface active agent, preferably an alkylbenzene sulfonate, to from 100 to 150 ml of the above aqueous electrolytic solution, and further adding from 2 to 20 mg of a sample to be measured. The electrolytic solution in which the sample has been suspended is subjected to dispersion for about 1 minute to about 3 minutes in an ultrasonic dispersion machine. The volume distribution and number distribution of particles are calculated by measuring the volume and number of toner particles by means of the above Coulter counter Model TA-II, using an aperture of 100 μm as its aperture. Then the weight-based, weight average particle diameter (D4) is determined from the volume distribution.

(6) Measurement of hydrophobicity:

Methanol titration is an experimental means for ascertaining the hydrophobicity of fine titanium oxide particles whose surfaces have been made hydrophobic.

"Methanol titration" as defined in the present specification for evaluating the hydrophobicity of treated fine titanium oxide particles is carried out in the following way: 0.2 g of fine titanium oxide particles to be tested are added to 50 ml of water contained in an Erlenmeyer flask with a volume of 250 ml. Methanol is dropwise added from a buret until the whole fine titanium oxide particles have been swelled. Here, the solution inside the flask is continually stirred by means of a magnetic stirrer. The end point can be observed upon suspension of the whole fine titanium oxide particles in the solution. The hydrophobicity is expressed as a percentage of the methanol present in the liquid mixture of methanol and water when the reaction has reached the end point.

(7) Measurement of fog density:

To evaluate fog, its density is measured using REFLECTOMETER MODEL TC-6DS, manufactured by Tokyo Denshoku K.K. In the case of cyan toner images, an amber filter is used, and the fog is calculated according to the following expression. The smaller the value is, the less the fog is.

Fog (reflectance) (%) = Reflectance (%) of standard paper − Reflectance (%) of non-image areas of sample Reflectance (%) of standard paper uses an average value of 5 points measurement and reflectance (%) of non-image areas of sample uses a minimum value of 5 points measurement.

(8) Measurement of specific surface area:

Measured according to the following procedure, using a powder specific surface area measuring device manufactured by Shimadzu Corporation (Model SS-100).

1. To fill a powder tester with a sample iron powder, the power source of its autosliduck is put on and the voltage is adjusted to 100 V.
2. The powder tester is switched to tapping, and its timer is adjusted to 1 minute (50 times±1 time per minute).
3. A sieve plate is put in a sample cylinder made of plastic, and then a sheet of filter paper is put down on the plate, on which the sample is put by ⅓ of the sample cylinder.
4. The sample cylinder is set on a tapping stand of the powder tester, and the starting button is set on (tapping for 1 minute).
5. In the sample cylinder thus tapped, the sample is further put by ⅔ of the sample cylinder.
6. The same operation as 4. is repeated.
7. A sub-cylinder made of plastic is inserted to the top of the sample cylinder, and the sample is heaped from the top thereof.
8. The same operation as 4 and 6 is repeated.
9. From the sample cylinder thus tapped, the subcylinder is pull out, and the remaining excess sample is cut with a spatula.
10. A specific surface area measuring tube is filled with water up to the mark S.
11. The sample cylinder is connected to the measuring tube. (After packed with the sample, grease is applied to the fitting surfaces.)

12. A cock of an outlet at the lower part is opened, and a stopwatch is started at the time the water surface in the measuring tube passes the mark 0. (The water flowed out at the lower part is received in a beaker.)
13. Time for which the water surface drops to the mark 20 (unit: cc) is measured.
14. The sample cylinder is detached to measure the weight of the sample.
15. The specific surface area is calculated according to the following expression.

$$SW = \frac{14}{\rho}\sqrt{\frac{\Delta PAT}{\eta LQ}\cdot\frac{\epsilon^2}{(1-\epsilon)^2}}$$

$$\epsilon = 1 - W/\rho AL$$

wherein;

SW is a specific surface area of powder ($cm^2/g$);

$\epsilon$ is a void of the sample-packed layer;

$\rho$ is a density of powder ($g/cm^3$);

$\eta$ is a coefficient of viscosity of the fluid (g/cm·sec);

L is a thickness of the sample layer (cm);

Q is a quantity of the fluid having permeated the sample layer (cc);

$\Delta P$ is a pressure difference between both ends of the sample layer ($g/cm^2$);

A is a sectional area of the sample layer ($cm^2$);

T is a time taken for Q cc of fluid (air) to permeate the sample layer (sec); and W is a weight of the sample (g).

(9) Measurement of average particle diameter of external additive:

To know the average particle diameter of the external additive (finely divided powder), the external additive is observed on a transmission electron microscope and diameters of 100 particles in the visual field are measured to determine their average particle diameter.

In the present invention, the carrier has carrier particles, and each carrier particle comprises a carrier core and a silicone resin coat layer for covering the carrier core, wherein the carrier particle has silicon atoms and carbon atoms on its surface in the ratio that satisfies the condition of:

Si/C=0.1 to 2.0 as the number of atoms present on the carrier particle surface as measured by XPS, and from 0.1% by number to 5% by number of metal atoms are present on the carrier particle surface. Hence, the rise of charging of the toner can be improved, the external additive of the toner may hardly adhere, the charge-up in an environment of low humidity or the leak of charges in an environment of high humidity may hardly occur to enable good charging in all environments, and stable images can be obtained; minus charges can be well imparted to the toner, and the carrier has a physical impact resistance high enough to hardly cause separation of coat layers; image density decrease and blurred images may hardly occur also when color originals having a large image area are continuously copied; and also fog-free and sharp images having a high image density and superior fine-line reproduction and highlight gradation can be formed.

EXAMPLES

The present invention will be described below in greater detail by giving Examples. In the following Examples, "part(s)" refers to "part(s) by weight" unless particularly noted.

Example 1

Unsaturated polyester resin 100 parts

Copper Phthalocyanine pigment (C.I. Pigment Blue 15) 5.0 parts

Charge control agent (chromium complex of salicylic acid) 4.0 parts

Materials of the above formulation were thoroughly premixed using a Henschel mixer, and then melt-kneaded using a twin-screw extruder. After cooled, the kneaded product was crushed using a hammer mill to give coarse particles of about 1 to 2 mm in diameter, which were then finely pulverized using a fine grinding mill of an air-jet system. The resulting finely pulverized product was classified by means of a multi-division classifier to obtain a classified product of 8.5 $\mu$m in particle size (colorant-containing resin particles, a toner). To the resin particles thus obtained, 1.0% by weight of hydrophobic titanium oxide having a hydrophobicity of 70%, an average particle diameter of 0.05 $\mu$m and a transmittance of 55% at 400 nm, which was prepared by mixing hydrophilic fine titanium oxide particles in an aqueous system with stirring during which n-$C_4H_9Si(OCH_3)_3$ was added and mixed so as to be in an amount of 30% by weight based on the weight of the fine titanium oxide particles and so as not to cause coalescence of particles, was added and blended using a mixer to obtain toner 1, a cyan toner.

Into a four-necked flask, 20 parts of toluene, 20 parts of butanol, 20 parts of water and 40 parts of ice were charged, and 40 parts of a mixture of 2 mols of $CH_3SiCl_3$ and 3 mols of $(CH_3)_2SiCl_2$ was added thereto with stirring. After stirring further 30 minutes, condensation reaction was carried out at 60° C. for 1 hour to obtain silicone resin 1.

Silicone resin 1 (organopolysiloxane resin) 100 parts $C_6H_5—NHCH_2CH_2CH_2Si(OCH_3)_3$ (N-phenylaminopropyltrimethoxysilane) 2 parts Cu—Zn—Fe ferrite cores were coated with a mixture of the above materials in a coating weight of 0.5% by weight to produce carrier 1. In this carrier 1, the ratio of Si/C as the number of atoms present on the carrier particle surface as measured by XPS was 0.6; the total of metal atoms Cu, Zn and Fe was 0.5% by number; the weight average particle diameter was 45 $\mu$m; in weight distribution, the carrier particles with particle diameters not smaller than 26 $\mu$m to smaller than 35 $\mu$m were in a content of 16% by weight, the carrier particles with particle diameters not smaller than 35 $\mu$m to smaller than 43 $\mu$m, 15% by weight, and the carrier particles with particle diameters not smaller than 74 $\mu$m, 0% by weight; and the electrical current value under application of a voltage of 500 V was 70 $\mu$A.

Based on 5 parts of the above cyan toner 1, the carrier 1 was blended in an amount making 100 parts in total weight, to obtain a two-component type developer.

Using the two-component type developer thus obtained and using a commercially available color copying machine (CLC-500, manufactured by Canon Inc.), a 5,000 sheet running test was made in an environment of 23° C./5% RH at a development contrast set at 350 V and in an environment of 30° C./80% RH at a development contrast set at 300 V. As a result, the image density was as stable as 1.40 to 1.60, and high-quality images free of fog and toner scatter and with a superior halftone reproduction were obtained. A 30,000 sheet long-term running test was also made in an environment of 23° C./60% RH. As a result, the developer caused no deterioration, and high-quality images were obtained also after the running test.

Example 2

Styrene-acrylate resin 100 parts

Carbon black 4.0 parts

Charge control agent (chromium complex of salicylic acid) 4.0 parts

Using materials of the above formulation, the melt-kneading, pulverization and classification were carried out in the same manner as in Example 1 to obtain a classified product of 8.2 μm in particle size (colorant-containing resin particles, a toner). To the resin particles thus obtained, the same hydrophobic titanium oxide as that prepared in Example 1 was added in an amount of 0.8% by weight was added and blended using a mixer to obtain toner 2, a black toner.

Based on 5 parts of this toner 2, the carrier 1 as used in Example 1 was blended in an amount making 100 parts in total weight, to obtain a two-component type developer.

Using the two-component type developer thus obtained, images were reproduced in the same manner as in Example 1 in an environment of 23° C./5% RH. As a result, the image density was as stable as 1.50 to 1.70, and high-quality images with a superior halftone reproduction were obtained. A 40,000 sheet long-term running test was also made in an environment of 23° C./60% RH. As a result, the developer caused no deterioration, and high-quality images were obtained also after the running test.

Example 3

Images were reproduced in the same manner as in Example 1 except that the cyan toner was replaced with a cyan toner, toner 3, making use of hydrophilic fine titanium oxide particles treated with 15 parts of $n\text{-}C_{10}H_{25}Si(OCH_3)_3$ (hydrophobicity: 70%; average particle diameter: 0.05 μm; transmittance at 400 nm: 45%). As a result, good results were obtained.

Example 4

Silicone resin 2 was obtained by changing as shown in Table 1 the silicone monomer in the silicone resin 1 used in the preparation of the carrier 1.

Silicone resin 2 (acryl-modified silicone resin) 100 parts $C_6H_5—NHCH_2CH_2Si(OCH_3)_3$ (N-phenylaminopropyltrimethoxysilane) 3 parts Cu—Zn—Fe ferrite cores were coated with a mixture of the above materials in a coating weight of 0.4% by weight to produce carrier 2. In this carrier 2, the ratio of Si/C as the number of atoms present on the carrier particle surface as measured by XPS was 0.6; the total of metal atoms Cu, Zn and Fe was 0.4% by number; the weight average particle diameter was 43 μm; in weight distribution, the carrier particles with particle diameters not smaller than 26 μm to smaller than 35 μm were in a content of 15% by weight, the carrier particles with particle diameters not smaller than 35 μm to smaller than 43 μm, 16% by weight, and the carrier particles with particle diameters not smaller than 74 μm, 0% by weight; and the electrical current value under application of a voltage of 500 V was 68 μA. Based on 5 parts of the cyan toner 1 as used in Example 1, the carrier 2 was blended in an amount making 100 parts in total weight, to obtain a two-component type developer.

Images were reproduced in the same manner as in Example 1 except that the above two-component type developer was used. As a result, good results were obtained also after 50,000 sheet long-term running.

Example 5

Silicone resin 3 was obtained by changing as shown in Table 1 the silicone monomer in the silicone resin 1 used in the preparation of the carrier 1.

Silicone resin 3 (acryl-modified silicone resin) 100 parts $NH_2CH_2CH_2NHCH_2CH_2CH_2Si(OCH_3)_3$ (γ-(2-aminoethyl)aminopropyltrimethoxysilane) 2 parts Cu—Zn—Fe ferrite cores were coated with a mixture of the above materials in a coating weight of 0.5% by weight to produce carrier 3. In this carrier 3, the ratio of Si/C as the number of atoms present on the carrier particle surface as measured by XPS was 0.25; the total of metal atoms Cu, Zn and Fe was 0.4% by number; the weight average particle diameter was 46 μm; in weight distribution, the carrier particles with particle diameters not smaller than 26 μm to smaller than 35 μm were in a content of 14% by weight, the carrier particles with particle diameters not smaller than 35 μm to smaller than 43 μm, 15% by weight, and the carrier particles with particle diameters not smaller than 74 μm, 0% by weight; and the electrical current value under application of a voltage of 500 V was 71 μA. Based on 5 parts of the cyan toner 1 as used in Example 1, the carrier 3 was blended in an amount making 100 parts in total weight, to obtain a two-component type developer.

Images were reproduced in the same manner as in Example 1 except that the above two-component type developer was used. As a result, good results were obtained also after 50,000 sheet long-term running.

Comparative Example 1

Silicone resin 4 was obtained by changing as shown in Table 1 the silicone monomer in the silicone resin 1 used in the preparation of the carrier 1.

Silicone resin 4 (organopolysiloxane silicone resin) 100 parts

Methyl-tri-(methylethylketoxy)silane 13 parts

Cu—Zn—Fe ferrite cores were coated with a mixture of the above materials in a coating weight of 0.5% by weight to produce carrier 4. In this carrier 4, the ratio of Si/C as the number of atoms present on the carrier particle surface as measured by XPS was 2.6; the total of metal atoms Cu, Zn and Fe was 0.4% by number; the weight average particle diameter was 48 μm; in weight distribution, the carrier particles with particle diameters not smaller than 26 μm to smaller than 35 μm were in a content of 16% by weight, the carrier particles with particle diameters not smaller than 35 μm to smaller than 43 μm, 17% by weight, and the carrier particles with particle diameters not smaller than 74 μm, 0% by weight; and the electrical current value under application of a voltage of 500 V was 72 μA. Based on 5 parts of the cyan toner 1 as used in Example 1, the carrier 4 was blended in an amount making 100 parts in total weight, to obtain a two-component type developer.

Images were reproduced in the same manner as in Example 1 except that the above two-component type developer was used. As a result, the rise of charging became slow in an environment of 23° C./5% RH, where the image density at the initial stage was 1.7 but the image density decreased to 1.2 after 1,000 sheet running.

Comparative Example 2

In Example 1, the amount of the coating material added was changed to 2% by weight to obtain carrier 5 in which the total of metal atoms Cu, Zn and Fe was 0.03% by number and the electrical current value under application of a voltage of 500 V was 17 μA. Based on 5 parts of the cyan toner 1 as used in Example 1, the carrier 5 thus obtained was blended in an amount making 100 parts in total weight, to obtain a two-component type developer. Images were reproduced in the same manner as in Example 1 except that this developer was used. As a result, the developer caused charge-up in the environment of 23° C/5% RH, and faulty transfer occurred after 1,000 sheet running.

Comparative Example 3

In Example 1, the amount of the coating material added was changed to 0.1% by weight to obtain carrier 6 in which the total of metal atoms Cu, Zn and Fe was 6% by number and the electrical current value under application of a voltage of 500 V was 200 $\mu$A. Based on 5 parts of the cyan toner 1 as used in Example 1, the carrier 6 thus obtained was blended in an amount making 100 parts in total weight, to obtain a two-component type developer. Images were reproduced in the same manner as in Example 1 except that this developer was used. As a result, the developer caused leak of charges in the environment of 30° C./80% RH, and toner scatter occurred after 1,000 sheet running.

Comparative Example 4

Silicone resin 5 was obtained by changing as shown in Table 1 the silicone monomer in the silicone resin 1 used in the preparation of the carrier 1.

Silicone resin 5 100 parts $C_6H_5$—NH—(—$CH_2$—)$_3$—Si($OCH_3$)$_3$ 3 parts

Using a mixture of the above materials, the preparation of the carrier 2 was repeated to obtain carrier 7 in which the ratio of Si/C as the number of atoms present on the carrier particle surface as measured by XPS was 0.07 and the total of metal atoms Cu, Zn and Fe was 0.6% by number. Images were reproduced in the same manner as in Example 1 except that a developer making use of this carrier was used. As a result, on 50,000 sheet long-term running, carrier deterioration due to adhesion of fine titanium oxide particles occurred to cause fog and toner scatter.

Reference Example 1

Images were reproduced in the same manner as in Example 1 except that the cyan toner was replaced with a cyan toner, toner 4, making use of hydrophilic fine titanium oxide particles not treated with the coupling agent (hydrophobicity: 0%). As a result, charges decreased in the environment of 30° C./80% RH, and toner scatter occurred on the 1,000th sheet copying and thereafter.

The constitution and physical properties of the carriers 1 to 7 used in the foregoing Examples and Comparative Examples are shown in Table 1.

TABLE 1

| Carrier No. | Coating solution: Silicone resin (monomer molar ratio) | Coating solution: Coupling agent (parts) | Coating weight | Si/C | * by number Metal atoms (%)* |
|---|---|---|---|---|---|
| 1 | $(CH_3)_2SiCl + CH_3SiCl_3$ (3:2) | $C_6H_5$—NH—(—$CH_2$—)$_3$—Si($OCH_3$)$_3$ (2) | 0.5 | 0.6 | 0.5 |
| 2 | $(CH_3)_2SiCl_2 + CH_3SiCl +$ $CH_2$=CHCOO—(—$CH_2$—)$_{12}$—Si($CH_3$)$Cl_2$ (50:50:1) | $C_6H_5$—NH—(—$CH_2$—)$_3$—Si($OCH_3$)$_3$ (3) | 0.4 | 0.6 | 0.6 |
| 3 | $(C_6H_5)_2SiCl_2+$ $(CH_3)_2SiCl_2 + CH_3SiCL_3 +$ $CH_2$=CHCOO—(—$CH_2$—)$_{12}$—Si($CH_3$)$Cl_2$ (8:8:16:1) | $NH_2CH_2CH_2NH$—(—$CH_2$—)$_3$—Si($OCH_3$)$_3$ (2) | 0.5 | 0.25 | 0.4 |
| 4 | $(CH_3)_2SiCl + CH_3SiCl_3 + SiCl_4$ (1:5:14) | $CH_3$—Si—(—ON=C($CH_3$)$C_2H_5$)$_3$ (13) | 0.5 | 2.6 | 0.4 |
| 5 | $(CH_3)_2SiCl + CH_3SiCl_3$ (3:2) | $C_6H_5$—NH—(—$CH_2$—)$_3$—Si($OCH_3$)$_3$ (2) | 2.0 | 0.6 | 0.03 |
| 6 | $(CH_3)_2SiCl + CH_3SiCl_3$ (3:2) | $C_6H_5$—NH—(—$CH_2$—)$_3$—Si($OCH_3$)$_3$ (2) | 0.1 | 0.6 | 6.0 |
| 7 | $(C_6H_5)_2SiCl_2 + C_6H_5SiCl_3 +$ $CH_2$=CHCOO—(—$CH_2$—)$_{12}$—Si($CH_3$)$Cl_2$ (1:1:4) | $C_6H_5$—NH—(—$CH_2$—)$_3$—Si($OCH_3$)$_3$ (3) | 0.4 | 0.07 | 0.6 |

Preparation of Carrier 8

Using $(CH_3)_2SiCl_2$ as a starting material, hydrolysis and condensation reaction were carried out to synthesize resin A.

Next, using as a starting material a mixture of the following materials;

$(CH_3)_2SiCl_2$ 50 parts $CH_3SiCl_3$ 50 parts resin B was synthesized in the same manner as the resin A.

Then, using $CH_3SiCl_3$ as a starting material, resin C was synthesized in the same manner as the resin A. The resins A, B and C were mixed in the following proportion;

Resin A 10 parts

Resin B 80 parts

Resin C 10 parts to obtain silicone resin 1 of (I)/(II)/(III)=10/80/10.

Based on 100 parts of this resin 1, 3 parts each of methyltrioxysilane and methyltrimethoxysilane were added, followed by dilution with xylene to prepare a carrier coating solution.

This carrier coating solution was applied to Cu—Zn spherical ferrite particles with an average particle diameter of 40 $\mu$m using a coater (SPIRA COATER, manufactured by Okada Seiko Co.) so as to have a resin coating weight of 0.5 part by weight.

The carrier having been thus coated was dried at 60° C. for 1 hour to remove the solvent, further followed by heating at 180° C. for 1 hours to obtain resin-coated carrier 8.

In this carrier 8, the ratio of Si/C as the number of atoms present on the carrier particle surface as measured by XPS was 0.67; the total of metal atoms Cu, Zn and Fe was 0.5% by number; the weight average particle diameter was 43 $\mu$m;

in weight distribution, the carrier particles with particle diameters not smaller than 26 μm to smaller than 35 μm were in a content of 7% by weight, the carrier particles with particle diameters not smaller than 35 μm to smaller than 43 μm, 64% by weight, and the carrier particles with particle diameters not smaller than 74 μm, 0.5% by weight; and the electrical current value under application of a voltage of 500 V was 60 μA.

The constitution and physical properties of the carrier are shown in Tables 2 and 3.

Preparation of Carriers 9 to 24

In Preparation of Carrier 8, the carrier particle diameter, the proportion of (I)/(II)/(III) and the amounts of methyltrioxysilane and methyltrimethoxysilane were changed to obtain resin-coated carriers 9 to 24 as shown in Tables 2 and 3.

Preparation of Carrier 25

Preparation of Carrier 8 was repeated to obtain resin-coated carrier 25 as shown in Tables 2 and 3, except that the segment (II) was replaced with one in which $R^2$ is phenyl.

TABLE 3-continued

| Carrier No. | Si/C | Number of metal atoms (%)* | 500 V Elec. current value (μA) | Weight av. particle diam. (μm) | Carrier particles with particle diameters of: ≧26–<35 μm (% by weight) | ≧35–<43 μm (% by weight) | ≧74 μm (% by weight) |
|---|---|---|---|---|---|---|---|
| 19 | 0.67 | 1.3 | 55 | 44 | 9 | 59 | 0.6 |
| 20 | 1.0 | 1.5 | 40 | 50 | 3 | 12 | 1.0 |
| 21 | 0.95 | 1.5 | 40 | 49 | 3 | 14 | 0.9 |
| 22 | 0.56 | 0.3 | 80 | 41 | 13 | 67 | 0.1 |
| 23 | 0.67 | 0.3 | 75 | 52 | 2 | 11 | 1.0 |
| 24 | 0.67 | 0.2 | 85 | 61 | 1 | 9 | 1.0 |
| 25 | 0.30 | 0.5 | 60 | 44 | 8 | 60 | 0.6 |

*% by number

Preparation of Toner 5

Polyester resin obtained by condensation of propoxylated bisphenol and fumaric acid 100 parts
Phthalocyanine pigment 4 parts
Chromium complex of di-tert-butylsalicylic acid 4 parts

TABLE 2

| Carrier No. | Carrier core 1) | Resin segments (I)/(II)/(III) | Additive (IV) (parts) | Additive (V) (parts) | a* | S** | a/S × $10^4$ |
|---|---|---|---|---|---|---|---|
| 8 | 40 μm, Cu—Zn | 10/80/10, $R^0$–$R^6$ = $CH_3$ | $R^7$,$R^8$ = $CH_3$, $R^9$ = $C_2H_5$ (3) | R,$R^{10}$ = $CH_3$ (3) | 0.5 | 410 | 12.2 |
| 9 | 40 μm, Cu—Zn | 10/80/10, $R^0$–$R^6$ = $CH_3$ | $R^7$,$R^8$ = $CH_3$, $R^9$ = $C_2H_5$ (0.5) | R,$R^{10}$ = $CH_3$ (8) | 0.5 | 400 | 12.3 |
| 10 | 40 μm, Cu—Zn | 10/80/10, $R^0$–$R^6$ = $CH_3$ | $R^7$,$R^8$ = $CH_3$, $R^9$ = $C_2H_5$ (8) | R,$R^{10}$ = $CH_3$ (0.5) | 0.5 | 395 | 12.6 |
| 11 | 40 μm, Cu—Zn | 10/80/10, $R^0$–$R^6$ = $CH_3$ | $R^7$,$R^8$ = $CH_3$, $R^9$ = $C_2H_5$ (0.3) | R,$R^{10}$ = $CH_3$ (0.3) | 0.5 | 430 | 11.6 |
| 12 | 40 μm, Cu—Zn | 10/80/10, $R^0$–$R^6$ = $CH_3$ | $R^7$,$R^8$ = $CH_3$, $R^9$ = $C_2H_5$ (10) | R,$R^{10}$ = $CH_3$ (10) | 0.5 | 345 | 14.5 |
| 13 | 40 μm, Cu—Zn | 10/80/10, $R^0$–$R^6$ = $CH_3$ | $R^7$,$R^8$ = $CH_3$, $R^9$ = $C_2H_5$ (0.1) | R,$R^{10}$ = $CH_3$ (0.1) | 0.5 | 440 | 11.4 |
| 14 | 40 μm, Cu—Zn | 10/80/10, $R^0$–$R^6$ = $CH_3$ | $R^7$,$R^8$ = $CH_3$, $R^9$ = $C_2H_5$ (0) | R,$R^{10}$ = $CH_3$ (3) | 0.5 | 450 | 11.1 |
| 15 | 40 μm, Cu—Zn | 10/80/10, $R^0$–$R^6$ = $CH_3$ | $R^7$,$R^8$ = $CH_3$, $R^9$ = $C_2H_5$ (15) | R,$R^{10}$ = $CH_3$ (3) | 0.5 | 360 | 13.9 |
| 16 | 40 μm, Cu—Zn | 10/80/10, $R^0$–$R^6$ = $CH_3$ | $R^7$,$R^8$ = $CH_3$, $R^9$ = $C_2H_5$ (3) | R,$R^{10}$ = $CH_3$ (15) | 0.5 | 375 | 13.3 |
| 17 | 40 μm, Cu—Zn | 20/80/0, $R^0$–$R^6$ = $CH_3$ | $R^7$,$R^8$ = $CH_3$, $R^9$ = $C_2H_5$ (3) | R,$R^{10}$ = $CH_3$ (3) | 0.5 | 445 | 11.2 |
| 18 | 40 μm, Cu—Zn | 5/10/85, $R^0$–$R^6$ = $CH_3$ | $R^7$,$R^8$ = $CH_3$, $R^9$ = $C_2H_5$ (3) | R,$R^{10}$ = $CH_3$ (3) | 0.5 | 370 | 13.5 |
| 19 | 40 μm, Cu—Zn | 0/100/0, $R^0$–$R^6$ = $CH_3$ | $R^7$,$R^8$ = $CH_3$, $R^9$ = $C_2H_5$ (3) | R,$R^{10}$ = $CH_3$ (3) | 0.5 | 400 | 12.5 |
| 20 | 40 μm, Cu—Zn | 0/0/100, $R^0$–$R^6$ = $CH_3$ | $R^7$,$R^8$ = $CH_3$, $R^9$ = $C_2H_5$ (3) | R,$R^{10}$ = $CH_3$ (3) | 0.5 | 340 | 14.7 |
| 21 | 40 μm, Cu—Zn | 0/10/90, $R^0$–$R^6$ = $CH_3$ | $R^7$,$R^8$ = $CH_3$, $R^9$ = $C_2H_5$ (3) | R,$R^{10}$ = $CH_3$ (3) | 0.5 | 345 | 14.5 |
| 22 | 40 μm, Cu—Zn | 60/40/0, $R^0$–$R^6$ = $CH_3$ | $R^7$,$R^8$ = $CH_3$, $R^9$ = $C_2H_5$ (3) | R,$R^{10}$ = $CH_3$ (3) | 0.5 | 455 | 11.0 |
| 23 | 40 μm, Cu—Zn | 10/80/10, $R^0$–$R^6$ = $CH_3$ | $R^7$,$R^8$ = $CH_3$, $R^9$ = $C_2H_5$ (3) | R,$R^{10}$ = $CH_3$ (3) | 0.45 | 325 | 13.8 |
| 24 | 40 μm, Cu—Zn | 10/80/10, $R^0$–$R^6$ = $CH_3$ | $R^7$,$R^8$ = $CH_3$, $R^9$ = $C_2H_5$ (3) | R,$R^{10}$ = $CH_3$ (3) | 0.4 | 275 | 14.5 |
| 25 | 40 μm, Cu—Zn | 10/80/10, $R^2$ = Ph, $R^0$,$R^1$,$R^3$–$R^6$ = $CH_3$ | $R^7$,$R^8$ = $CH_3$, $R^9$ = $C_2H_5$ (3) | R,$R^{10}$ = $CH_3$ (3) | 0.5 | 390 | 12.8 |

1) Cu—Zn ferrire
*Resin coating weight
**Carrier specific surface area

TABLE 3

| Carrier No. | Si/C | Number of metal atoms (%)* | 500 V Elec. current value (μA) | Weight av. particle diam. (μm) | Carrier particles with particle diameters of: ≧26–<35 μm (% by weight) | ≧35–<43 μm (% by weight) | ≧74 μm (% by weight) |
|---|---|---|---|---|---|---|---|
| 8 | 0.67 | 0.5 | 60 | 43 | 7 | 64 | 0.5 |
| 9 | 0.68 | 0.4 | 50 | 44 | 7 | 62 | 0.6 |
| 10 | 0.68 | 0.6 | 55 | 44 | 8 | 61 | 0.6 |
| 11 | 0.67 | 0.4 | 65 | 42 | 10 | 67 | 0.5 |
| 12 | 0.68 | 0.8 | 55 | 49 | 5 | 14 | 0.8 |
| 13 | 0.67 | 0.3 | 70 | 41 | 15 | 69 | 0.1 |
| 14 | 0.67 | 0.3 | 75 | 41 | 14 | 70 | 0.2 |
| 15 | 0.68 | 1.4 | 85 | 48 | 2 | 29 | 0.8 |
| 16 | 0.68 | 0.3 | 85 | 47 | 4 | 31 | 0.8 |
| 17 | 0.63 | 0.3 | 50 | 41 | 12 | 68 | 0.2 |
| 18 | 0.92 | 1.1 | 45 | 47 | 3 | 32 | 0.7 |

The above materials were thoroughly premixed using a Henschel mixer, and then melt-kneaded using a twin-screw extruder. After cooled, the kneaded product was crushed using a hammer mill to give coarse particles of about 1 to 2 mm in diameter, which were then finely pulverized using a fine grinding mill of an air-jet system. The resulting finely pulverized product was classified by means of a multi-division classifier to obtain a negatively triboelectrically chargeable cyan color powder (a toner) with a weight average particle diameter of 8.3 μm.

100 parts of the cyan color powder and 1.0 part of fine titanium oxide particles were blended by means of a Henschel mixer to obtain cyan toner 5.

Example 6

The above cyan toner 5 and the above carrier 8 were blended in a toner concentration of 8% by weight to produce a two-component type developer, and images were reproduced on 5,000 copy sheets from an original having an image area percentage of 25%, using a color copying machine (CLC-500, manufactured by Canon Inc.) in environments of 30° C./80% RH and 30° C./90% RH each, to obtain the results as shown in Table 4.

As is seen from Table 4, the above developer causes only small variations in the running test, has no problem on toner scatter after 5,000 sheet running, and is very good.

Test results on the following Examples and Comparative Examples are also shown in Table 4.

Example 7

Using the carrier 9, the same test as in Example 6 was made to obtain good results as shown in Table 4.

Example 8

Using the carrier 10, the same test as in Example 6 was made. As a result, toner scatter slightly occurred after 5,000 sheet running in the environment of 30° C./90% RH, which, however, was at a level of no problem, and good results were obtained on other items.

Example 9

Using the carrier 11, the same test as in Example 6 was made. As a result, good results were obtained in the environment of 30° C./80% RH. In the environment of 30° C./90% RH, toner scatter slightly occurred after 5,000 sheet running and both image density and fog a little increased, which, however, were all at levels of no problem.

Example 10

Using the carrier 12, the same test as in Example 6 was made. As a result, good results were obtained in the environment of 30° C./80% RH. In the environment of 30° C./90% RH, toner scatter slightly occurred after 5,000 sheet running and both image density and fog tended to be a little higher throughout the running from the initial stage, which, however, were all at levels of no problem.

Example 11

Using the carrier 13, the same test as in Example 6 was made. As a result, good results were obtained in the environment of 30° C./80% RH. In the environment of 30° C./90% RH, toner scatter slightly occurred after 5,000 sheet running and both image density and fog a little increased, which, however, were all at levels of no problem.

Example 12

Using the carrier 17, the same test as in Example 6 was made. As a result, good results were obtained in the environment of 30° C./80% RH. In the environment of 30° C./90% RH, both image density and fog tended to be a little higher throughout the 5,000 sheet running from the initial stage, which, however, were stably tended to occur at levels of no problem, and also only slightly toner scatter occurred.

Example 13

Using the carrier 18, the same test as in Example 6 was made. As a result, good results were obtained in the environment of 30° C./80% RH. In the environment of 30° C./90% RH, both image density and fog a little increased after 5,000 sheet running, which, however, were at levels of no problem, and also only slightly toner scatter occurred.

Example 14

Using the carrier 23, the same test as in Example 6 was made. As a result, good results were obtained in the environment of 30° C./80% RH. In the environment of 30° C./90% RH, fog a little increased after the running and also toner scatter was slightly seen, which, however, were all at levels of no problem.

Example 15

Using the carrier 25, the same test as in Example 6 was made to obtain good results as shown in Table 4.

Example 16

Using the carrier 14, the same test as in Example 6 was made. As a result, good results were obtained in the environment of 30° C./80% RH. In the environment of 30° C./90% RH, however, both image density and fog occurred after 5,000 sheet running, and toner scatter was also seen.

It is presumed that the use of only the additive (IV) has achieved no well cross-linking to cause a low durability of the carrier, resulting in a decrease in the quantity of triboelectricity.

Example 17

Using the carrier 15, the same test as in Example 6 was made. As a result, good results were obtained in the environment of 30° C./80% RH. In the environment of 30° C./90% RH, however, both image density and fog were higher throughout the 5,000 sheet running from the initial stage, and toner scatter was also seen.

It is presumed that the use of too much additive (III) has caused oximes to remain in the coat layers in a large quantity, resulting in an unsatisfactory water repellency to make chargeability short.

Example 18

Using the carrier 16, the same test as in Example 6 was made. As a result, good results were obtained in the environment of 30° C./80% RH. In the environment of 30° C./90% RH, however, both image density and fog increased after 5,000 sheet running, and toner scatter also occurred.

It is presumed that the use of too much additive (IV) has caused unreacted additives to remain in the polymers in a large quantity, resulting in a short toughness of the coat layers to make the durability lower.

Example 19

Using the carrier 19, the same test as in Example 6 was made. As a result, good results were obtained in the environment of 30° C./80% RH. In the environment of 30° C./90% RH, however, both image density and fog were higher throughout the 5,000 sheet running from the initial stage, and toner scatter was also occurred at an undesirable level.

It is presumed that no incorporation of the resin component (I) has made the elasticity of coat layers short to cause the coat layers to separate as a result of the running because of their brittleness, and also that the cross-linking component used in a large quantity has hindered the eliminable groups of the cross-linking agent from being released from the coat layers, resulting in a lowering of water repellency of the coat layers.

Example 20

Using the carrier 20, the same test as in Example 6 was made. As a result, good results were obtained in the environment of 30° C./80% RH. In the environment of 30°

C./90% RH, however, image density and fog increased after 5,000 sheet running, and toner scatter was also seen.

It is presumed that the use of too much resin component (III) has made the eliminable groups of the cross-linking agent remain in a large quantity, and also that the brittle coat layers have caused their separation during the running.

It is presumed that the carrier having a small surface area has caused a decrease in charging rate, and also that the combination between core surface irregularities and the silicone resin has become less effective to cause a decrease in the durability of coat layers.

TABLE 4

| | | 30° C./80% RH | | | | | 30° C./90% RH | | | | |
|---|---|---|---|---|---|---|---|---|---|---|---|
| | | Initial Stage | | After 5,000 sheet running | | | Initial Stage | | After 5,000 sheet running | | |
| Example: | Carrier No. | Macbeth image density | Fog density | Macbeth image density | Fog density | Toner scatter | Macbeth image density | Fog density | Macbeth image density | Fog density | Toner scatter |
| 6 | 8 | 1.50 | 0.7 | 1.53 | 0.9 | AA | 1.51 | 0.9 | 1.54 | 1.0 | A |
| 7 | 9 | 1.50 | 0.8 | 1.55 | 1.1 | AA | 1.51 | 0.9 | 1.57 | 1.1 | A |
| 8 | 10 | 1.56 | 1.0 | 1.60 | 1.3 | AA | 1.58 | 1.1 | 1.62 | 1.5 | AB |
| 9 | 11 | 1.55 | 1.0 | 1.60 | 1.4 | AA | 1.57 | 1.2 | 1.62 | 1.6 | AB |
| 10 | 12 | 1.61 | 1.4 | 1.63 | 1.7 | AA | 1.62 | 1.5 | 1.64 | 1.7 | AB |
| 11 | 13 | 1.54 | 0.9 | 1.61 | 1.5 | AA | 1.55 | 1.0 | 1.64 | 1.7 | AB |
| 12 | 17 | 1.61 | 1.5 | 1.62 | 1.7 | AA | 1.61 | 1.6 | 1.62 | 1.8 | AB |
| 13 | 18 | 1.49 | 1.0 | 1.57 | 1.6 | AA | 1.50 | 1.0 | 1.60 | 1.8 | AB |
| 14 | 23 | 1.61 | 1.1 | 1.64 | 1.6 | AA | 1.62 | 1.2 | 1.65 | 1.9 | AB |
| 15 | 25 | 1.51 | 1.0 | 1.54 | 1.1 | AA | 1.52 | 1.0 | 1.55 | 1.1 | A |
| 16 | 14 | 1.56 | 1.3 | 1.68 | 1.9 | A | 1.59 | 1.4 | 1.73 | 2.2 | B |
| 17 | 15 | 1.61 | 1.4 | 1.67 | 1.9 | AB | 1.63 | 1.6 | 1.70 | 2.2 | C |
| 18 | 16 | 1.55 | 1.0 | 1.63 | 1.8 | A | 1.57 | 1.1 | 1.67 | 2.0 | B |
| 19 | 19 | 1.62 | 1.5 | 1.65 | 1.9 | AB | 1.63 | 1.7 | 1.66 | 2.2 | C |
| 20 | 20 | 1.57 | 1.3 | 1.6 | 2.0 | AB | 1.59 | 1.5 | 1.69 | 2.5 | C |
| 21 | 21 | 1.50 | 1.1 | 1.62 | 1.9 | A | 1.52 | 1.2 | 1.66 | 2.1 | B |
| 22 | 22 | 1.60 | 1.4 | 1.64 | 1.8 | A | 1.61 | 1.6 | 1.65 | 2.0 | B |
| 23 | 24 | 1.57 | 1.1 | 1.65 | 1.9 | A | 1.59 | 1.2 | 1.68 | 2.1 | B |

AA: Not occurred at all; A: Good; AB: No problem in practical use; B: Problematic; C: Poor

Example 21

Using the carrier 21, the same test as in Example 6 was made. As a result, good results were obtained in the environment of 30° C./80% RH. In the environment of 30° C./90% RH, however, image density and fog increased after 5,000 sheet running, and toner scatter was also seen.

It is presumed that no incorporation of the resin component (I) has made the coat layers relatively brittle to cause their break during the running.

Example 22

Using the carrier 22, the same test as in Example 6 was made. As a result, good results were obtained in the environment of 30° C./80% RH. In the environment of 30° C./90% RH, however, both image density and fog increased after 5,000 sheet running, and toner scatter was also seen.

It is presumed that the use of too much resin component (I) has made the toughness of coat layers short to cause a shortage of durability.

Example 23

Using the carrier 24, the same test as in Example 6 was made, except that the developer was prepared in a toner concentration of 7% by weight. As a result, good results were obtained in the environment of 30° C./80% RH. In the environment of 30° C./90% RH, however, both image density and fog increased after 5,000 sheet running although the initial-stage performance was good, and toner scatter was also seen.

To evaluate fog, its density was measured using REFLECTOMETER MODEL TC-6DS, manufactured by Tokyo Denshoku K.K. In the case of cyan toner images, an amber filter was used, and the fog was calculated according to the following expression. The smaller the value is, the less the fog is. Fog (reflectance) (%)=Reflectance (%) of standard paper—Reflectance (%) of non-image areas of sample

Preparation of Carrier 26

Into a four-necked flask, 20 parts of toluene, 20 parts of butanol, 20 parts of water and 40 parts of ice were charged, and 40 parts of a mixture of 15 mols of $CH_3SiCl_3$ and 10 mols of $(CH_3)_2SiCl_2$ was added thereto with stirring. After stirring further 30 minutes, condensation reaction was carried out at 60° C. for 1 hour. Thereafter, the siloxane was thoroughly washed with water, and dissolved in a mixed solvent of toluene, xylene and butanol. Thus, a silicone varnish with a solid content of 10% was prepared.

To this silicone varnish, 2.0% by weight of a hardening agent represented by the formula:

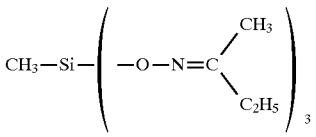

was added based on a content of siloxane solid component to prepare a carrier coating solution.

This coating solution was applied to Cu—Zn spherical ferrite particles with an average particle diameter of 45 $\mu$m using a coater (SPIRA COATER, manufactured by Okada Seiko Co.) so as to have a resin coating weight of 0.3 part by weight.

The carrier having been thus coated was dried at 60° C. for 1 hour to remove the solvent, further followed by heating at 200° C. for 1 hours to obtain resin-coated carrier 26.

Physical properties of this carrier are shown in Tables 5 and 6.

Preparation of Carriers 27 to 38

Resin-coated carriers 27 to 38 were obtained in the same manner as in Preparation of Carrier 19 but under conditions as shown in Tables 5 and 6.

TABLE 5

| Carier No. | Hardening agent | Amount | a* | S** | a/S × $10^4$ |
|---|---|---|---|---|---|
| 26 | 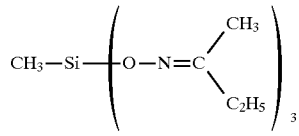 | 2.0 | 0.3 | 340 | 8.2 |
| 27 | 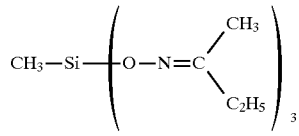 | 2.0 | 0.5 | 340 | 14.7 |
| 28 | 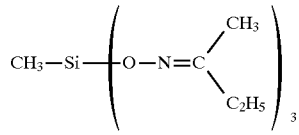 | 2.0 | 2.0 | 340 | 58.8 |
| 29 | 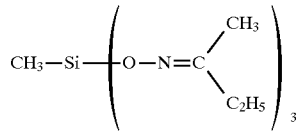 | 2.0 | 0.1 | 340 | 2.9 |
| 30 | 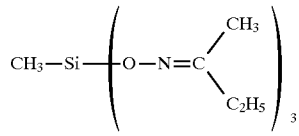 | 2.0 | 0.05 | 340 | 1.5 |
| 31 | 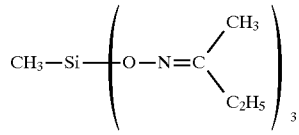 | 2.0 | 1.0 | 340 | 29.4 |
| 32 | 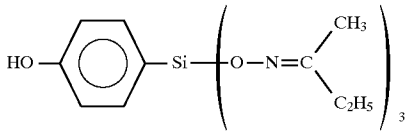 | 2.0 | 1.0 | 340 | 29.4 |
| 33 | 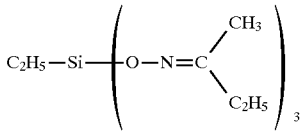 | 2.0 | 1.0 | 340 | 29.4 |
| 34 | $CH_3-Si-(-OCH_3)_3$ | 2.0 | 1.0 | 340 | 29.4 |
| 35 | 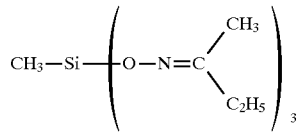 | 2.0 | 0.5 | 450 | 11.1 |
| 36 | 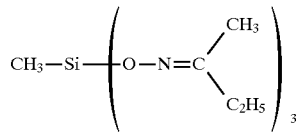 | 2.0 | 0.5 | 550 | 9.1 |
| 37 | None | — | 0.3 | 340 | 8.8 |

TABLE 5-continued

| Carier No. | Hardening agent | Amount | a* | S** | a/S × $10^4$ |
|---|---|---|---|---|---|
| 38 | 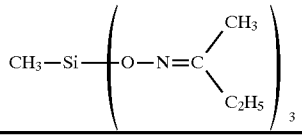 | 12.0 | 0.3 | 340 | 8.8 |

*Resin coating weight
**Carrier specific surface area

TABLE 6

| Carrier No. | Si/C | Number of metal atoms (%)* | 500 V Elec. current value (μA) | Weight av. particle diam. (μm) | Carrier particles with particle diameters of: ≧26–<35 μm (% by weight) | ≧35–<43 μm | ≧74 μm |
|---|---|---|---|---|---|---|---|
| 26 | 0.72 | 3.7 | 75 | 46 | 15 | 31 | 0 |
| 27 | 0.72 | 2.1 | 60 | 47 | 12 | 30 | 0 |
| 28 | 0.72 | 0.05 | 15 | 50 | 5 | 21 | 0.1 |
| 29 | 0.72 | 4.7 | 145 | 45 | 17 | 34 | 0 |
| 30 | 0.72 | 9 | 210 | 45 | 17 | 34 | 0 |
| 31 | 0.72 | 0.2 | 30 | 48 | 9 | 27 | 0 |
| 32 | 0.72 | 0.4 | 40 | 48 | 9 | 27 | 0 |
| 33 | 0.72 | 0.3 | 35 | 48 | 8 | 26 | 0 |
| 34 | 0.72 | 8 | 205 | 48 | 9 | 27 | 0 |
| 35 | 0.72 | 3.2 | 70 | 47 | 11 | 31 | 0 |
| 36 | 0.72 | 4.1 | 95 | 47 | 12 | 30 | 0 |
| 37 | 0.71 | 9 | 215 | 48 | 1 | 40 | 0 |
| 38 | 0.72 | 10 | 230 | 50 | 6 | 21 | 0.2 |

*% by number

Example 24

The above cyan toner 5 and the above carrier 26 were blended in a toner concentration of 5% by weight to produce a two-component type developer, and images were reproduced on 10,000 copy sheets at a development contrast of 300 V from an original having an image area percentage of 25%, using a color copying machine (CLC-500, manufactured by Canon Inc.) in an environments of 23° C./65% RH, to obtain the results as shown in Table 7.

As is seen from Table 7, the above two-component type developer causes only small variations in the running test, has no problem on toner scatter after 10,000 sheet running, and is very good. Results of evaluation are shown in Table 7.

Examples 25 to 29, Comparative Examples 5 to 9

Two-component type developers were prepared in the same manner as in Example 24 except that the carrier 26 used therein was respectively replaced with the carriers shown in Table 6 and in the combination as shown in Table 7, and evaluation was made similarly to obtain the evaluation results as shown in Table 7.

Examples 30 and 31

Two-component type developers were prepared in the same manner as in Example 24 except that the carrier 26 used therein was respectively replaced with the carriers shown in Table 6 and in the combination as shown in Table 7 and that the toner concentration was changed to 6% by weight (Example 30) and 7% by weight (Example 31), respectively. Evaluation was also made in the same manner except that the development contrast was changed to 250 V (Example 30) and 220 V (Example 31.), respectively, to obtain the evaluation results as shown in Table 7.

TABLE 7

| | Carrier No. | Image density | Fog (max %) | Durability | Toner scatter |
|---|---|---|---|---|---|
| Examples: | | | | | |
| 24 | 26 | AA | 1.2% | AA | AA |
| 25 | 27 | A | 1.2% | AA | AA |
| 26 | 29 | AA | 1.5% | A | A |
| 27 | 31 | AA | 1.5% | A | A |
| 28 | 32 | AA | 1.5% | AA | A |
| 29 | 33 | AA | 1.6% | AA | A |
| 30 | 35 | A | 1.2% | A | AA |
| 31 | 36 | A | 1.2% | A | AA |
| Comparative Example: | | | | | |
| 5 | 28 | C | 1.5% | B | A |
| 6 | 30 | A | 2.0% | B | C |
| 7 | 34 | A | 2.0% | C | C |
| 8 | 37 | A | 2.5% | C | C |
| 9 | 38 | B | 3.5% | C | C |

AA:Excellent;
A:Good;
B:No problem in practical use;
C: Problematic in practical use

Preparation of Carrier 39

Into a four-necked flask, 20 parts of toluene, 20 parts of butanol, 20 parts of water and 40 parts of ice were charged, and 40 parts of a mixture of 15 mols of $CH_3SiCl_3$ and 10 mols of $(CH_3)_2SiCl_2$ was added thereto with stirring. After stirring further 30 minutes, condensation reaction was carried out at 60° C. for 1 hour. Thereafter, the siloxane was thoroughly washed with water, and dissolved in a mixed solvent of toluene, xylene and butanol. Thus, a silicone varnish with a solid content of 10% was prepared.

To this silicone varnish, 2.0% by weight of a hardening agent represented by the formula:

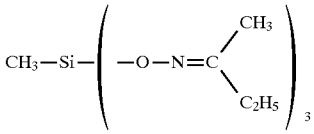

and 2.0% by weight of an amino silane coupling agent represented by the formula:

$$H_2N-C_2H_4-\overset{H}{N}-C_3H_6-Si-(-OCH_3)_3$$

were added to prepare a carrier coating solution.

This coating solution was applied to carrier cores A shown in Table 8, using a coater (SPIRA COATER, manufactured by Okada Seiko Co.) so as to have a resin coating weight of 0.3 part by weight. Thus, a coated carrier 39 was obtained.

In this carrier 39, the ratio of Si/C as the number of atoms present on the carrier particle surface as measured by XPS was 0.5; the total of metal atoms Cu, Zn and Fe was 0.5% by number; the weight average particle diameter was 45 μm; in weight distribution, the carrier particles with particle diameters not smaller than 26 μm to smaller than 35 μm were in a content of 16% by weight, the carrier particles with particle diameters not smaller than 35 μm to smaller than 43 μm, 15% by weight, and the carrier particles with particle diameters not smaller than 74 μm, 0% by weight; and the electrical current value under application of a voltage of 500 V was 68 μA.

Preparation of Carriers 40 to 49

Coated carriers 40 to 49 were prepared in the same manner as in Preparation of Carrier 39 except that the carrier cores, coating solution and coating weight as used therein were changed as shown in Table 8.

Physical properties of the coated carriers 39 to 49 are shown together in Table 8.

TABLE 8

*in terms of oxide

| Carrier No.: | 39 | 40 | 41 | 42 | 43 | 44 |
|---|---|---|---|---|---|---|
| Carrier core: | A | B | C | A | A | A |
| Composition: | Cu—Zn—Fe | Cu—Zn—Fe | Cu—Zn—Fe | Cu—Zn—Fe | Cu—Zn—Fe | Cu—Zn—Fe |
| (ratio)*: | (15:15:70) | (15:15:70) | (15:15:70) | (15:15:70) | (15:15:70) | (15:15:70) |
| Magnetization, | | | | | | |
| Satur. ($Am^2/kg$): | 64 | 64 | 64 | 64 | 64 | 64 |
| Resid. ($Am^2/Kg$): | 0 | 0 | 0 | 0 | 0 | 0 |
| Weight av. particles diameter (μm): | 45 | 64 | 23 | 45 | 45 | 45 |
| Particle diameters of | | | | | | |
| ≧26 to <35 μm: | 17 wt. % | 0.6 wt. % | 55 wt. % | 17 wt. % | 17 wt. % | 17 wt. % |
| ≧35 to <43 μm: | 15 wt. % | 4.1 wt. % | 5.0 wt. % | 15 wt. % | 15 wt. % | 15 wt. % |
| ≧74 82 m: | 0 wt. % | 20.0 wt. % | 0 wt. % | 0 wt. % | 0 wt. % | 0 wt. % |
| Coating solution | | | | | | |
| Aminosilane coupling | | | | | | |
| agent: | Comp. (13) | Comp. (13) | Comp. (13) | None | Comp. (13) | Comp. (13) |
| Amount: | 2 parts | 2 parts | 2 parts | 0 part | 2 parts | 2 parts |
| Hardening | | | | | | |
| agent: | Comp. (18) | Comp. (18) | Comp. (18) | Comp. (18) | Comp. (18) | Comp. (18) |
| Amount: | 2 parts | 2 parts | 2 parts | 2 parts | 2 parts | 2 parts |
| Coated carrier | | | | | | |
| Coating weight a: | 0.3 | 0.3 | 1.0 | 0.3 | 0.01 | 1.5 |
| Spec. s. area S: | 310 | 250 | 820 | 315 | 315 305 | |
| $(a/S) \times 10^4$: | 9.7 | 12.0 | 12.2 | 9.5 | 0.32 | 49.2 |
| Weight av. particle diameter (μm): | 45 | 65 | 23 | 46 | 45 | 47 |
| Particle diameters of | | | | | | |
| ≧26 to <35 μm: | 16 wt. % | 0.5 wt. % | 54 wt. % | 15 wt. % | 18 wt. % | 14 wt. % |
| ≧35 to <43 μm: | 15 wt. % | 4.2 wt. % | 5.3 wt. % | 19 wt. % | 15 wt. % | 12 wt. % |
| ≧74 μm: | 0 wt. % | 20.3 wt. % | 0 wt. % | 0.8 wt. % | 0 wt. % | 0 wt. % |
| Elec. current value at 500 V: (μA) | 68 | 70 | 180 | 75 | 315 | 17 |
| Si/C: | 0.5 | 0.6 | 0.5 | 0.4 | 0.6 | 0.8 |
| Metal atoms: (% by number) | 1.6 | 1.3 | 5.5 | 1.7 | 6.8 | 0.2 |

| Carrier No.: | 45 | 46 | 47 | 48 | 49 |
|---|---|---|---|---|---|
| Carrier core: | D | D | A | A | A |
| Composition: | Cu—Zn—Fe | Cu—Zn—Fe | Cu—Zn—Fe | Cu—Zn—Fe | Cu—Zn—Fe |
| (ratio)*: | (15:15:70) | (15:15:70) | (15:15:70) | (15:15:70) | (15:15:70) |
| Magnetization, | | | | | |
| Satur. ($Am^2/kg$): | 64 | 64 | 64 | 64 | 64 |
| Resid. ($Am^2/Kg$): | 0 | 0 | 0 | 0 | 0 |
| Weight average particle diameter (μm): | 34 | 34 | 45 | 45 | 45 |
| Particle diameters of | | | | | |
| ≧26 to <35 μm: | 40 wt. % | 40 wt. % | 17 wt. % | 17 wt. % | 17 wt. % |

TABLE 8-continued

| | | | | | *in terms of oxide |
|---|---|---|---|---|---|
| ≧35 to <43 μm: | 31 wt. % | 31 wt. % | 15 wt. % | 15 wt. % | 15 wt. % |
| ≧74 82 m: | 0 wt. % | 0 | 0 wt. % | 0 | 0 wt. % |
| Coating solution | | | | | |
| Aminosilane coupling | | | | | |
| agent: | Comp. (13) | Comp. (13) | Comp. (13) | Comp. (11) | Comp. (13) |
| Amount: | 2 parts | 2 parts | 2 parts | 2 parts | 2 parts |
| Hardening | | | | | |
| agent: | Comp. (18) | Comp. (18) | Comp. (18) | Comp. (18) | None |
| Amount: | 2 parts | 2 parts | 2 parts | 2 parts | 0 part |
| Coated carrier | | | | | |
| Coating weight a: | 0.8 | 1.0 | 1.0 | 0.4 | 0.3 |
| Spec. s. area S: | 480 | 480 | 320 | 310 | 310 |
| $(a/S) \times 10^4$: | 16.7 | 20.8 | 31.3 | 12.9 | 9.7 |
| Weight average particle diameter (μm): | 34 | 34 | 48 | 46 | 45 |
| Particle diameters of | | | | | |
| ≧26 to <35 μm: | 39 wt. % | 39 wt. % | 13 wt. % | 15 wt. % | 15 wt. % |
| ≧35 to <43 μm: | 33 wt. % | 32 wt. % | 17 wt. % | 15 wt. % | 15 wt. % |
| ≧74 μm: | 0 wt. % | 0 wt. % | 0 wt. % | 0 wt. % | 0 wt. % |
| Elec. current value at 500 V: (μA) | 90 | 80 | 25 | 40 | 72 |
| Si/C: | 0.6 | 0.6 | 0.6 | 0.7 | 0.4 |
| Metal atoms: (% by number) | 2.2 | 2.1 | 0.3 | 1.2 | 1.7 |

Preparation of Toner 6

Polyester resin obtained by condensation of propoxylated bisphenol and fumaric acid 100 parts Phthalocyanine pigment 4 parts Chromium complex of di-tert-butylsalicylic acid 4 parts The above materials were thoroughly premixed using a Henschel mixer, and then melt-kneaded using a twin-screw extruder. After cooled, the kneaded product was crushed using a hammer mill to give coarse particles of about 1 to 2 mm in diameter, which were then finely pulverized using a fine grinding mill of an air-jet system. The resulting finely pulverized product was classified by means of a multi-division classifier to obtain a negatively triboelectrically chargeable cyan color powder (a toner) with a weight average particle diameter of 8.3 μm.

100 parts of the cyan color powder and 1.0 part of spherical anatase type fine titanium oxide particles (average particle diameter: 0.05 μm hydrophobicity: 60%; transmittance at 400 nm: 65%) having been treated with 15 parts of $n\text{-}C_4H_9Si(OCH_3)_3$ and 5 parts of a dimethylpolysiloxane emulsion of 100 cSt in an aqueous system were blended by means of a Henschel mixer to obtain cyan toner 6.

Example 32

The above cyan toner 6 and 94 parts of the carrier 39 shown in Table 8 were blended based on 6 parts of the cyan toner to produce a two-component type developer.

Using the two-component type developer thus obtained and using a commercially available color copying machine manufactured by Canon Inc. (CLC-500; comprising a developing sleeve with a built-in magnet roller comprised of five poles having a development main pole of 960 gauss), a running test was made in an environment of 23° C./60% RH, where the alternating electric field as shown in FIG. 1 was superimposed.

Development was carried out under conditions set to be $V_{cont}$=250 V and $V_{back}$=—130 V.

As a result, good images with an image density of 1.6 to 1.7 were obtained, achieving a superior highlight reproduction and an image reproduction faithful to an original chart even after running on 30,000 sheets and 40,000 sheets. During continuous copying, images were also obtained without causing any carrier adhesion and density variation, and the developer concentration was well and stably controllable.

Images were also reproduced on 40,000 sheets in environments of 23° C./5% RH and 30° C./80% RH. As a result, good results were obtained.

The results are shown in Tables 9 and 10.

Example 33

Tests were made in the same manner as in Example 32 except that the carrier 39 used therein was replaced with the carrier 40. As a result, as shown in Table 9, results not problematic in practical use were obtained in the environment of 23° C./60% RH at least after 30,000 sheet running. After 40,000 sheet running, as shown in Table 10, toner scatter occurred. No evaluation test was made in the environments of 30° C./80% RH and 23° C./5% RH.

Comparative Example 10

Tests were made in the same manner as in Example 32 except that the carrier 39 used therein was replaced with the carrier 41. As a result, as shown in Table 9, carrier adhesion occurred in the environment of 23° C./60% RH after 30,000 sheet running. After 40,000 sheet running, as shown in Table 10, the uniformity of solid images lowered and also carrier adhesion occurred. No evaluation test was made in the environments of 30° C./80% RH and 23° C./5% RH.

Example 34

Tests were made in the same manner as in Example 33 except that the toner concentration of the developer was changed to 4% by weight. As a result, as shown in Table 9, results not problematic in practical use were obtained in the environment of 23° C./60% RH at least after 30,000 sheet running. After 40,000 sheet running, as shown in Table 10, toner scatter was better prevented than the case of Example 33, but halftone uniformity, solid-image uniformity and fine-line reproduction lowered. No evaluation test was made in the environments of 30° C./80% RH and 23° C./5% RH.

Comparative Example 11

Tests were made in the same manner as in Comparative Example 10 except that the toner concentration of the developer was changed to 9% by weight. As a result, as shown in Table 9, carrier adhesion occurred in the environment of 23° C./60% RH after 30,000 sheet running. After 40,000 sheet running, as shown in Table 10, carrier adhesion also occurred. No evaluation test was made in the environments of 30° C./80% RH and 23° C./5% RH.

Example 35

Tests were made in the same manner as in Example 32 except that the carrier 39 used therein was replaced with the carrier 42. As a result, as shown in Tables 9 and 10, results not problematic in practical use were obtained in the environment of 23° C./60% RH both after 30,000 sheet running and after 40,000 sheet running. In the environment of 30° C./80% RH, as shown in Table 10, fog and toner scatter occurred after 40,000 sheet running. No evaluation test was made in the environment of 23° C./5% RH.

Comparative Example 12

Tests were made in the same manner as in Example 32 except that the carrier 39 used therein was replaced with the carrier 43. As a result, as shown in Table 9, fog, deterioration of halftone uniformity and carrier adhesion occurred in the environment of 23° C./60% RH after 30,000 sheet running. After 40,000 sheet running, as shown in Table 10, the uniformity of solid images further deteriorated. No evaluation test was made in the environments of 30° C./80% RH and 23° C./5% RH.

Example 36

Tests were made in the same manner as in Example 32 except that the carrier 39 used therein was replaced with the carrier 44. As a result, as shown in Tables 9 and 10, results not problematic in practical use were obtained in the environment of 23° C./60% RH both after 30,000 sheet running and after 40,000 sheet running. In the environment of 30° C./80% RH, as shown in Table 10, results not problematic in practical use were obtained even after 40,000 sheet running. In the environment of 23° C./5% RH, however, fog occurred and solid-image uniformity deteriorated.

Examples 37 and 38

Tests were made in the same manner as in Example 32 except that the carrier 39 used therein was replaced with the carrier 45 and the carrier 46, respectively. As a result, as shown in Tables 9 and 10, good results were obtained.

Example 39

Tests were made in the same manner as in Example 32 except that the carrier 39 used therein was replaced with the carrier 47. As a result, as shown in Tables 9 and 10, results not problematic in practical use were obtained in the environments of 23° C./60% RH and 30° C./80% RH. No evaluation test was made in the environment of 23° C./5% RH.

Examples 40 and 41

Tests were made in the same manner as in Example 32 except that the carrier 39 used therein was replaced with the carrier 48 and the carrier 49, respectively. As a result, as shown in Tables 9 and 10, good results were obtained.

TABLE 9

Ex.:Example; Cp.:Comparative Example

| | Ex.32 | Ex.33 | Cp.10 | Ex.34 | Cp.11 | Ex.35 | Cp.12 |
|---|---|---|---|---|---|---|---|
| Carrier No.: | 39 | 40 | 41 | 40 | 41 | 42 | 43 |
| Toner No.: | 6 | 6 | 6 | 6 | 6 | 6 | 6 |
| Toner concentration: | 6% | 6% | 6% | 4% | 9% | 6% | 6% |
| Alternating electric field: | Fig.1 | Fig.1 | Fig.1 | Fig.1 | Fig.1 | Fig.1 | Fig.1 |
| After 30,000 sheet running 23° C./60% RH | | | | | | | |
| Image density: | 1.6–1.7 | 1.7–1.8 | 1.4–1.6 | 1.2–1.3 | 1.9–2.0 | 1.6–1.7 | 1.5–1.7 |
| Fog:(maximum %) | 0.7% | 1.2% | 0.8% | 1.6% | 2.3% | 1.0% | 2.6% |
| Halftone uniformity: | AA | A | B | B | A | AA | C |
| Solid uniformity: | AA | A | B | B | A | A | B |
| Fine-line reproduction: | AA | A | B | B | A | AA | B |
| Carrier adhesion: | AA | AA | C | AA | C | A | C |
| Toner scatter: | AA | B | AA | A | B | B | B |

Ex.:Example

| | Ex.36 | Ex.37 | Ex.38 | Ex.39 | Ex.40 | Ex.41 |
|---|---|---|---|---|---|---|
| Carrier No.: | 44 | 45 | 46 | 47 | 48 | 49 |
| Toner No.: | 6 | 6 | 6 | 6 | 6 | 6 |
| Toner concentration: | 6% | 8% | 8% | 6% | 6% | 6% |
| Alternating electric field: | Fig.1 | Fig.1 | Fig.1 | Fig.1 | Fig.1 | Fig.1 |

TABLE 9-continued

| After 30,000 sheet running 23° C./60% RH | | | | | | |
|---|---|---|---|---|---|---|
| Image density: | 1.4–1.5 | 1.7–1.8 | 1.7–1.8 | 1.6–1.7 | 1.7–1.8 | 1.6–1.7 |
| Fog:(maximum %) | 1.8% | 0.8% | 0.9% | 0.9% | 0.8% | 1.0% |
| Halftone uniformity: | A | AA | AA | AA | AA | A |
| Solid uniformity: | A | AA | AA | A | AA | AA |
| Fine-line reproduction: | B | AA | AA | A | AA | AA |
| Carrier adhesion: | B | A | A | B | AA | A |
| Toner scatter: | B | AA | AA | A | AA | A |

Evaluation:
AA:Excellent;
A:Good;
B:No problem in practical use;
C:Problematic in practical use

TABLE 10

Ex.: Example; Cp.: Comparative Example

| | Ex. 32 | Ex. 33 | Cp. 10 | Ex. 34 | Cp. 11 | Ex. 35 | Cp. 12 |
|---|---|---|---|---|---|---|---|
| Carrier No.: | 39 | 40 | 41 | 40 | 41 | 42 | 43 |
| Toner No.: | 6 | 6 | 6 | 6 | 6 | 6 | 6 |
| Toner concentration: | 6% | 6% | 6% | 4% | 9% | 6% | 6% |
| Alternating electric field: | FIG. 1 | FIG. 1 | FIG. 1 | FIG. 1 | FIG. 1 | FIG. 1 | FIG. 1 |
| After 40,000 sheet running | | | | | | | |
| 23° C./60% RH | | | | | | | |
| Image density: | 1.6–1.7 | 1.7–1.9 | 1.3–1.6 | 1.2–1.3 | 1.9–2.0 | 1.4–1.7 | 1.4–1.7 |
| Fog: (maximum %) | 0.8% | 2.0% | 1.0% | 2.5% | 2.7% | 1.5% | 3.1% |
| Halftone uniformity: | AA | B | B | C | A | A | C |
| Solid uniformity: | AA | A | C | C | B | A | C |
| Fine-line reprodn.: | AA | B | B | C | A | AA | B |
| Carrier adhesion: | AA | AA | C | AA | C | A | C |
| Toner scatter: | AA | C | AA | A | B | B | B |
| 30° C./80% RH | | | | | | | |
| Image density: | 1.6–1.7 | — | — | — | — | 1.7–1.9 | — |
| Fog: (maximum %) | 1.0% | — | — | — | — | 2.5% | — |
| Halftone uniformity: | AA | — | — | — | — | B | — |
| Solid uniformity: | AA | — | — | — | — | A | — |
| Fine-line reprodn.: | AA | — | — | — | — | B | — |
| Carrier adhesion: | AA | — | — | — | — | AA | — |
| Toner scatter: | AA | — | — | — | — | C | — |
| 23° C./5% RH | | | | | | | |
| Image density: | 1.5–1.6 | — | — | — | — | — | — |
| Fog: (maximum %) | 1.0% | — | — | — | — | — | — |
| Halftone uniformity: | AA | — | — | — | — | — | — |
| Solid uniformity: | AA | — | — | — | — | — | — |
| Fine-line reprodn.: | AA | — | — | — | — | — | — |
| Carrier adhesion: | AA | — | — | — | — | — | — |
| Toner scatter: | AA | — | — | — | — | — | — |

Ex.: Example

| | Ex. 36 | Ex. 37 | Ex. 38 | Ex. 39 | Ex. 40 | Ex. 41 |
|---|---|---|---|---|---|---|
| Carrier No.: | 44 | 45 | 46 | 47 | 48 | 49 |
| Toner No.: | 6 | 6 6 | 6 | 6 | 6 | |
| Toner concentration: | 6% | 8% | 8% | 6% | 6% | 6% |
| Alternating electric field: | FIG. 1 | FIG. 1 | FIG. 1 | FIG. 1 | FIG. 1 | FIG. 1 |
| After 40,000 sheet running | | | | | | |
| 23° C./60% RH | | | | | | |
| Image density: | 1.4–1.5 | 1.7–1.8 | 1.7–1.8 | 1.5–1.7 | 1.7–1.8 | 1.6–1.7 |
| Fog: (maximum %) | 2.0% | 0.9% | 1.0% | 1.3% | 1.0% | 1.5% |
| Halftone uniformity: | A | A | A | A | AA | A |
| Solid uniformity: | A | AA | AA | A | AA | AA |
| Fine-line reprodn.: | B | AA | AA | A | AA | AA |
| Carrier adhesion: | B | A | A | B | AA | A |
| Toner scatter: | B | AA | A | B | AA | A |

TABLE 10-continued

| | | | | | | |
|---|---|---|---|---|---|---|
| 30° C./80% RH | | | | | | |
| Image density: | 1.5–1.9 | 1.7–1.8 | 1.7–1.8 | 1.5–1.8 | 1.7–1.8 | 1.6–1.7 |
| Fog: (maximum %) | 1.5% | 1.0% | 1.3% | 1.8% | 1.2% | 1.5% |
| Halftone uniformity: | B | A | A | A | AA | A |
| Solid uniformity: | A | AA | AA | A | AA | AA |
| Fine-line reprodn.: | B | AA | AA | A | AA | AA |
| Carrier adhesion: | B | AA | A | B | AA | AA |
| Toner scatter: | B | AA | A | B | A | A |
| 23° C./5% RH | | | | | | |
| Image density: | 1.2–1.6 | 1.6–1.7 | 1.5–1.7 | — | 1.6–1.7 | 1.7–1.8 |
| Fog: (maximum %) | 2.3% | 1.0% | 1.3% | — | 1.3% | 1.5% |
| Halftone uniformity: | B | A | A | — | AA | A |
| Solid uniformity: | C | AA | A | — | AA | A |
| Fine-line reprodn.: | B | A | A | — | AA | A |
| Carrier adhesion: | B | A | A | — | AA | A |
| Toner scatter: | B | AA | A | — | AA | AA |

Evaluation:
AA: Excellent; A: Good; B: No problem in practical use; C: Problematic in practical use Reference Example 2

Figure 2:
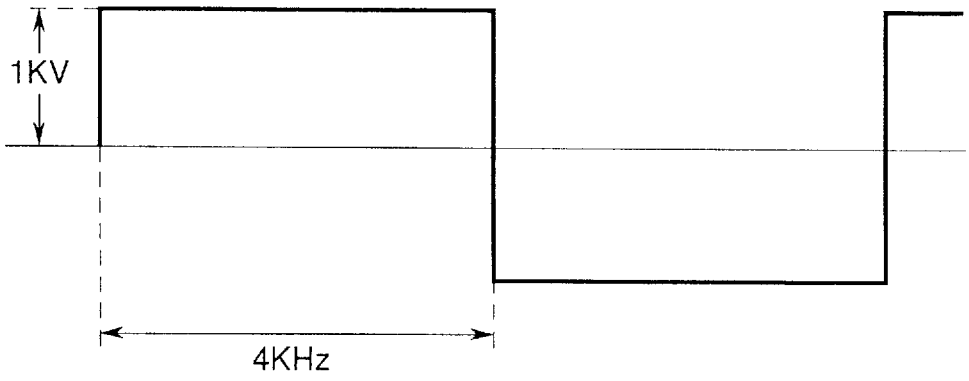
FIG. 2 shows a pattern of an alternating electric field used in Reference Examples of the present invention.

Tests were made in the same manner as in Example 32 except that the electric field used therein was replaced with the alternating electric field shown in FIG. 2. As a result, as shown in Table 11, results not problematic in practical use were obtained after 30,000 sheet running in the environment of 23° C./60% RH. After 40,000 sheet running, as shown in Table 12, image density decreased and fog increased compared with Example 32.

Examples 42 and 43

Figure 3:
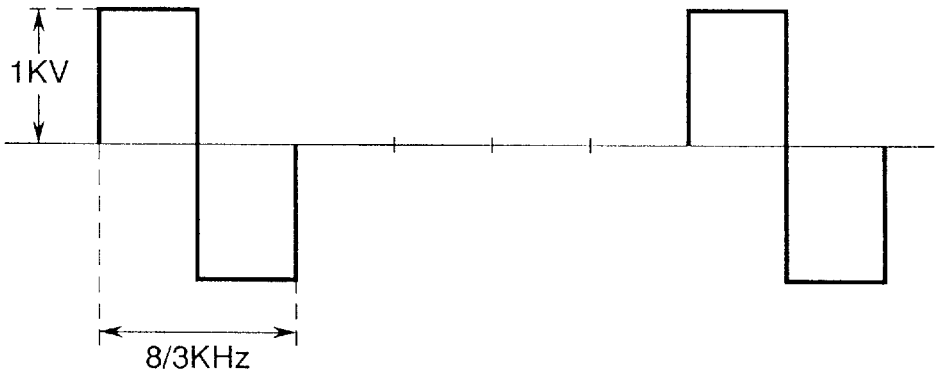
FIG. 3 shows a pattern of an alternating electric field used in Examples of the present invention.
Figure 4:
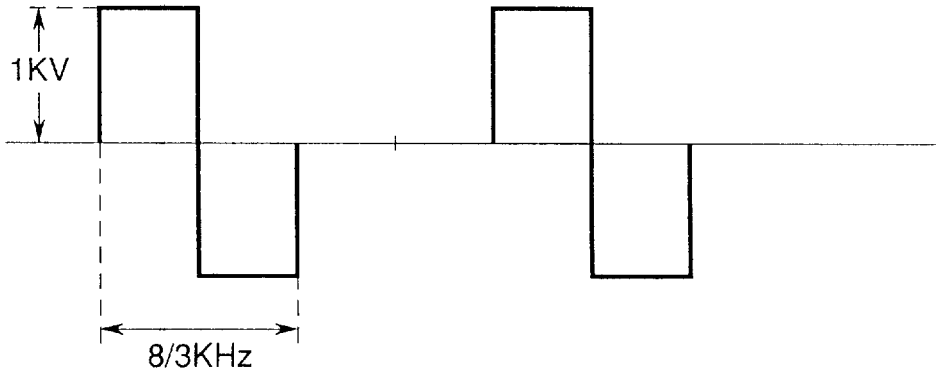
FIG. 4 shows another pattern of an alternating electric field used in Examples of the present invention.

Tests were made in the same manner as in Example 32 except that the electric field used therein was replaced with the alternating electric fields shown in FIGS. 3 and 4, respectively. As a result, as shown in Tables 11 and 12, good results were obtained. In particular, Example 42 was better than Example 43 because of less influence by environmental variations.

Preparation of Toners 7 and 8

Toners 7 and 8 were prepared in the same manner as in Preparation of Toner 6 except that the fine titanium oxide particles were not used (toner 7) or replaced with hydrophobic silica R972 (available from Nippon Aerosil Co., Ltd.) (toner 8).

Reference Example 3

Tests were made in the same manner as in Example 32 except that the toner 6 used therein was replaced with the toner 7. As a result, as shown in Tables 11 and 12, fog occurred and halftone uniformity, solid-image uniformity and fine-line reproduction lowered in the environment of 23° C./60% RH. No evaluation test was made in the environments of 30° C./80% RH and 23° C./5% RH.

Example 44

Tests were made in the same manner as in Example 32 except that the toner 6 used therein was replaced with the toner 8. As a result, as shown in Table 11, results not problematic in practical use were obtained after 30,000 sheet running in the environment of 23° C./60% RH. After 40,000 sheet running, as shown in Table 12, fog occurred and solid-image uniformity lowered. No evaluation test was made in the environments of 30° C./80% RH and 23° C./5% RH.

Preparation of Toner 9

Toner 9 was prepared in the same manner as in Preparation of Toner 6 except that the fine titanium oxide particles were replaced with pigment-purpose fine titanium oxide particles with an average particle diameter of 0.4 $\mu$m and a hydrophobicity of 50%.

Reference Example 4

Tests were made in the same manner as in Example 32 except that the toner 6 used therein was replaced with the toner 9. As a result, as shown in Tables 11 and 12, fog occurred and halftone uniformity lowered after 30,000 sheet running in the environment of 23° C./60% RH. After 40,000 sheet running, fine-line reproduction lowered and also toner scatter occurred. No evaluation test was made in the environments of 30° C./80% RH and 23° C./5% RH.

Preparation of Toner 10

Toner 10 was prepared in the same manner as in Preparation of Toner 6 except that the fine titanium oxide particles used therein were replaced with fine titanium oxide particles having an average particle diameter of 0.07 $\mu$m, a hydrophobicity of 45% and a transmittance of 40%, obtained by adding spherical anatase type hydrophilic titanium oxide in a mixed solvent of 95 parts of methanol and 5 parts of water together with $n\text{-}C_4H_9Si(OCH_3)_3$, followed by mixing treatment using a Henschel mixer, then drying and disintegration.

Example 45

Tests were made in the same manner as in Example 32 except that the toner 6 used therein was replaced with the toner 10. As a result, as shown in Tables 11 and 12, good results were obtained.

Preparation of Toner 11

Toner 11 was prepared in the same manner as in Preparation of Toner 6 except that the fine titanium oxide particles used therein were replaced with fine titanium oxide particles having an average particle diameter of 0.03 $\mu$m×0.10 $\mu$m, a hydrophobicity of 50% and a transmittance of 50%, obtained using the spherical rutile type hydrophilic titanium oxide.

Example 46

Tests were made in the same manner as in Example 32 except that the toner 6 used therein was replaced with the toner 11. As a result, as shown in Tables 11 and 12, good results were obtained.

Preparation of Toner 12

Toner 12 was prepared in the same manner as in Preparation of Toner 6 except that the fine titanium oxide particles used therein were replaced with fine titanium oxide particles having an average particle diameter of 0.05 μm, a hydrophobicity of 55% and a transmittance of 60%, obtained in the same manner except for use of no dimethylpolysiloxane.

Example 47

Tests were made in the same manner as in Example 32 except that the toner 6 used therein was replaced with the toner 12. As a result, as shown in Tables 11 and 12, good results were obtained.

Preparation of Toner 13

Toner 13 was prepared in the same manner as in Preparation of Toner 12 except that in addition to the fine titanium oxide particles used,therein 5 parts of fine titanium oxide particles having an average particle diameter of 0.07 μm, a hydrophobicity of 65% and a transmittance of 50%, obtained by adding and mixing dimethylpolysiloxane of 100 cSt using a Henschel mixer, followed by drying and disintegration.

Example 48

Tests were made in the same manner as in Example 32 except that the toner 6 used therein was replaced with the toner 13. As a result, as shown in Tables 11 and 12, good results were obtained.

TABLE 11

Ex.:Example

| | Ref. Ex.2 | Ex.42 | Ex.43 | Ref. Ex.3 | Ex.44 | Ref. Ex.4 |
|---|---|---|---|---|---|---|
| Carrier No.: | 39 | 39 | 39 | 39 | 39 | 39 |
| Toner No.: | 6 | 6 | 6 | 7 | 8 | 9 |
| Toner concentration: | 6% | 6% | 6% | 6% | 6% | 6% |
| Alternating electric field: | Fig.2 | Fig.3 | Fig.4 | Fig.1 | Fig.1 | Fig.1 |
| After 30,000 sheet running 23° C./60% RH | | | | | | |
| Image density: | 1.3–1.4 | 1.6–1.7 | 1.6–1.7 | 1.2–1.5 | 1.2–1.3 | 1.6–1.7 |
| Fog: (maximum %) | 1.7% | 0.5% | 0.5% | 2.2% | 1.5% | 1.6% |
| Halftone uniformity: | B | AA | A | C | A | C |
| Solid uniformity: | B | AA | AA | C | B | C |
| Fine-line reproduction: | B | AA | AA | C | A | B |
| Carrier adhesion: | A | AA | A | A | B | B |
| Toner scatter: | AA | AA | AA | B | B | B |

Ex.:Example

| | Ex.45 | Ex.46 | Ex.47 | Ex.48 |
|---|---|---|---|---|
| Carrier No.: | 39 | 39 | 39 | 39 |
| Toner No.: | 10 | 11 | 12 | 13 |
| Toner concentration: | 6% | 6% | 6% | 6% |
| Alternating electric field: | Fig.1 | Fig.1 | Fig.1 | Fig.1 |
| After 30,000 sheet running 23° C./60% RH | | | | |
| Image density: | 1.5–1.6 | 1.6–1.7 | 1.6–1.7 | 1.6–1.7 |
| Fog: (maximum %) | 0.9% | 1.0% | 0.7% | 0.8% |
| Halftone uniformity: | A | AA | AA | AA |
| Solid uniformity: | A | AA | A | AA |
| Fine-line reproduction: | A | A | AA | A |
| Carrier adhesion: | A | AA | AA | A |
| Toner scatter: | AA | AA | AA | AA |

Evaluation:
AA:Excellent;
A:Good;
B:No problem in practical use;
C:Problematic in practical use

TABLE 12

Ex.:Example

| | Ref. Ex. 2 | Ex. 42 | Ex. 43 | Ref. Ex. 3 | Ex. 44 | Ref. Ex. 4 |
|---|---|---|---|---|---|---|
| Carrier No.: | 39 | 39 | 39 | 39 | 39 | 39 |
| Toner No.: | 6 | 6 | 6 | 7 | 8 | 9 |
| Toner concentration: | 6% | 6% | 6% | 6% | 6% | 6% |
| Alternating electric field: | FIG. 2 | FIG. 3 | FIG. 4 | FIG. 1 | FIG. 1 | FIG. 1 |
| After 40,000 sheet running | | | | | | |
| 23° C./60% RH | | | | | | |
| Image density: | 1.2–1.4 | 1.6–1.7 | 1.6–1.7 | 1.2–1.5 | 1.2–1.3 | 1.4–1.7 |
| Fog: (maximum %) | 2.2% | 0.7% | 0.7% | 2.5% | 2.0% | 2.1% |
| Halftone uniformity: | B | AA | A | C | B | C |
| Solid uniformity: | B | AA | AA | C | C | C |
| Fine-line reproduction: | B | AA | AA | C | A | C |
| Carrier adhesion: | A | AA | A | B | B | A |
| Toner scatter: | AA | AA | AA | C | B | C |
| 30° C./80% RH | | | | | | |
| Image density: | — | 1.7–1.8 | 1.7–1.8 | — | — | — |
| Fog: (maximum %) | — | 1.0% | 1.0% | — | — | — |
| Halftone uniformity: | — | AA | A | — | — | — |
| Solid uniformity: | — | AA | AA | — | — | — |
| Fine-line reproduction: | — | AA | A | — | — | — |
| Carrier adhesion: | — | AA | AA | — | — | — |
| Toner scatter: | — | AA | AA | — | — | — |
| 23° C./5% RH | | | | | | |
| Image density: | — | 1.6–1.7 | 1.5–1.6 | — | — | — |
| Fog: (maximum %) | — | 0.9% | 1.3% | — | — | — |
| Halftone uniformity: | — | AA | A | — | — | — |
| Solid uniformity: | — | AA | AA | — | — | — |
| Fine-line | — | AA | A | — | — | — |

TABLE 12-continued

| | | | | | | |
|---|---|---|---|---|---|---|
| reproduction: | | | | | | |
| Carrier adhesion: | — | AA | AA | — | — | — |
| Toner scatter: | — | AA | A | — | — | — |

Ex.:Example

| | Ex. 45 | Ex. 46 | Ex. 47 | Ex. 48 |
|---|---|---|---|---|
| Carrier No.: | 39 | 39 | 39 | 39 |
| Toner No.: | 10 | 11 | 12 | 13 |
| Toner concentration: | 6% | 6% | 6% | 6% |
| Alternating electric field: | FIG. 1 | FIG. 1 | FIG. 1 | FIG. 1 |
| After 40,OO0 sheet running | | | | |
| 23° C./60% RH | | | | |
| Image density: | 1.5–1.6 | 1.6–1.7 | 1.6–1.7 | 1.5–1.7 |
| Fog: (maximum %) | 1.3% | 1.3% | 1.0% | 1.2% |
| Halftone uniformity: | A | A | AA | A |
| Solid uniformity: | A | A | A | AA |
| Fine-line reproduction: | A | A | AA | A |
| Carrier adhesion: | A | AA | AA | A |
| Toner scatter: | A | A | AA | AA |
| 30° C./80% RH | | | | |
| Image density: | 1.5–1.7 | 1.6–1.7 | 1.6–1.8 | 1.6–1.7 |
| Fog: (maximum %) | 1.5% | 1.5% | 1.0% | 1.1% |
| Halftone uniformity: | A | A | AA | A |
| Solid uniformity: | A | A | A | AA |
| Fine-line reproduction: | A | A | AA | A |
| Carrier adhesion: | A | AA | AA | AA |
| Toner scatter: | A | A | A | A |
| 23° C./5% RH | | | | |
| Image density: | 1.6–1.7 | 1.4–1.6 | 1.5–1.6 | 1.5–1.6 |
| Fog: (maximum %) | 1.5% | 1.5% | 0.9% | 1.1% |
| Halftone uniformity: | A | A | A | A |
| Solid uniformity: | A | A | A | AA |
| Fine-line reproduction: | A | A | AA | A |
| Carrier adhesion: | A | A | A | A |
| Toner scatter: | A | A | AA | A |

Evaluation:
AA: Excellent;
A: Good;
B: No problem in practical use;
C: Problematic in practical use

What is claimed is:

1. A carrier for electrophotography comprising carrier particles; each carrier particle comprising a carrier core and an organopolysiloxane resin coat layer that covers the carrier core, wherein;

said carrier particle has silicon atoms and carbon atoms on its surface in the ratio that satisfies the condition of:

$$Si/C=0.1 \text{ to } 2.0$$

as the number of atoms present on the carrier particle surface as measured by X-ray photoelectron spectroscopy; and from 0.1% by number to 5% by number of metal atoms are present on the carrier particle surface;

said carrier has a weight average particle diameter of from 25 μm to 65μm, and contains, in its weight distribution, 1 to 40% by weight of carrier particles with particle diameters of not smaller than 26 μm to smaller than 35 μm; and said carrier has an electrical current value from 20 μA to 150 μA when a voltage of 500 V is applied.

2. The carrier according to claim 1, wherein said carrier particle has silicon atoms and carbon atoms on its surface in the ratio that satisfies the condition of:

$$Si/C=0.1 \text{ to } 0.7$$

as the number of atoms present on the carrier particle surface as measured by X-ray photoelectron spectroscopy.

3. The carrier according to claim 1, wherein the organopolysiloxane resin that forms said organopolysiloxane resin coat layer contains an aminosilane coupling agent.

4. The carrier according to claim 2, wherein said organopolysiloxane resin that forms the organopolysiloxane resin coat layer further contains a coupling agent represented by the formula:

$$R_{4-a}—Si—Xa$$

wherein $R_{4-a}$ represents a member selected from the group consisting of a vinyl group, a methacrylic group, an epoxy group, an amino group, and a mercapto group; a is 3; and X represents a member selected from the group consisting of a halogen atom and an alkoxyl group.

5. The carrier according to claim 1, wherein the organopolysiloxane resin that forms said organopolysiloxane resin coat layer contains an oxime hardening agent represented by the formula:

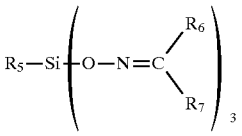

wherein $R_5$ represents a substituent selected from the group consisting of a methyl group, an ethyl group, and a phenyl group; and $R_6$ and $R_7$ each represent a substituent selected from the group consisting of a methyl group and an ethyl group.

6. The carrier according to claim 5, wherein said organopolysiloxane resin contains the oxime hardening agent in an amount of from 0.1 part by weight to 10 parts by weight based on 100 parts by weight of organopolysiloxane.

7. The carrier according to claim 1, wherein the organopolysiloxane resin layer has a coating weight that satisfies the following relation, when coating weight based on 100 g of carrier cores is represented by a g, and specific surface area of the carrier particles formed after coating is represented by S $cm^2/g$:

$$(a/S)\times10^4=2 \text{ to } 30$$

where a is 0.01 to 1.0.

8. The carrier according to claim 1, wherein the organopolysiloxane resin layer has a coating weight that satisfies the following relation, when coating weight based on 100 g of carrier cores is represented by a g, and specific surface area of the carrier particles formed after coating is represented by S $cm^2/g$:

$$(a/S)\times10^4=5 \text{ to } 20$$

where a is 0.01 to 1.0.

9. The carrier according to claim 1, wherein said carrier has a specific surface area of from 280 $cm^2/g$ to 600 $cm^2/g$.

10. The carrier according to claim 1, wherein said carrier has a specific surface area of from 300 $cm^2/g$ to 560 $cm^2/g$.

11. The carrier according to claim 1, wherein said carrier has a weight average particle diameter of from 25 μm to 65 μm, and contains, in its weight distribution, 1 to 40% by weight of carrier particles with particle diameters of not smaller than 26 μm to smaller than 35 μm, 5 to 40% by weight of carrier particles with particle diameters of not smaller than 35 μm to smaller than 43 μm and not more than 2% by weight of carrier particles with particle diameters of not smaller than 74 μm.

12. The carrier according to claim 1, wherein said carrier has a weight average particle diameter of from 30 μm to 65 μm, and contains, in its weight distribution, 1 to 40% by weight of carrier particles with particle diameters of not smaller than 26 μm to smaller than 35 μm, 5 to 40% by weight of carrier particles with particle diameters of not smaller than 35 μm to smaller than 43 μm and not more than 2% by weight of carrier particles with particle diameters of not smaller than 74 μm.

13. The carrier according to claim 1, wherein said carrier has an electrical current value of from 30 μA to 140 μA when a voltage of 500 V is applied.

14. The carrier according to claim 1, wherein said organopolysiloxane resin coat layer is formed using a resin composition containing i) an organopolysiloxane resin comprised of an aggregate of segments represented by the following Formulas (I) to (III) and ii) compounds represented by the following Formulas (IV) and (V):

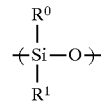

(I)

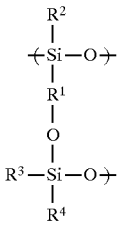

(II)

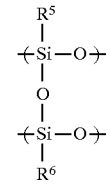

(III)

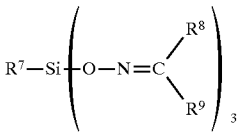

(IV)

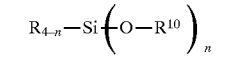

(V)

wherein $R^0$ to $R^{10}$ each represent a hydrocarbon group selected from the group consisting of a methyl group, an ethyl group, a phenyl group and a vinyl group; R represents a hydrocarbon group which may be substituted with an electron-donative group; and n represents an integer of 1 to 3.

15. The carrier according to claim 14, wherein said segments (I) to (III) are in the ratio that satisfies the condition of:

(I)/(II+III)=1/99 to 60/40 and (II)/(III)=10/90 to 100/0.

16. The carrier according to claim 14, wherein said segments (I) to (III) are in the ratio that satisfies the condition of:

(I)/(II+III)=2/88 to 50/50 and (II)/(III)=30/70 to 100/0.

17. The carrier according to claim 1, wherein said organopolysiloxane resin coat layer contains an aminosilane coupling agent represented by the formula $$R_m Si—Y_n$$

wherein R represents an alkoxyl group, Y represents a hydrocarbon group containing an amino group, m represents an integer of 1 to 3, and n represents an integer of 3 to 1; and said carrier has a weight average particle diameter of from 25 μm to 60 μm and has an electrical current value of from 20 μA to 150 μA when a voltage of 500 V is applied.

18. A two-component developer for developing electrostatic images, comprising a toner and a carrier; said carrier comprising carrier particles, and each carrier particle comprising a carrier core and an organopolysiloxane resin coat layer that covers the carrier core, wherein;

said carrier particle has silicon atoms and carbon atoms on its surface in the ratio that satisfies the condition of:

$$Si/C=0.1 \text{ to } 2.0$$

as the number of atoms present on the carrier particle surface as measured by X-ray photoelectron spectroscopy; and from 0.1% by number to 5% by number of metal atoms are present on the carrier particle surface;

said carrier has a weight average particle diameter of from 25 μm to 65 μm, and contains, in its weight distribution, 1 to 40% by weight of carrier particles with particle diameters of not smaller than 26 μm to smaller than 35 μm; and said carrier has an electrical current value of from 20 μA to 150 μA when a voltage of 500 V is applied.

19. The two-component developer according to claim 18, wherein said toner has an external additive with an average particle diameter of not larger than 0.2 μm.

20. The two-component developer according to claim 19, wherein said organopolysiloxane resin that forms the organopolysiloxane resin coat layer further contains a coupling agent represented by the formula:

$$R_{4-a}—Si—Xa$$

wherein $R_{4-a}$ represents a substituent selected from the group consisting of a vinyl group, a methacrylic group, an epoxy group, an amino group, and a mercapto group; a is 3, and X represents a member selected from the group consisting of a halogen atom and an alkoxyl group.

21. The two-component developer according to claim 18, wherein said toner has an external additive with an average particle diameter of from 0.002 μm to 0.2 μm.

22. The two-component developer according to claim 18, wherein said toner has a weight average particle diameter of from 1 μm to 10 μm, and a surface-treated titanium oxide having a weight average particle diameter of from 0.01 to 0.2 μm is externally added to said toner.

23. The two-component developer according to claim 18, wherein fine titanium oxide particles are externally added to said toner, and the fine titanium oxide particles have been surface-treated while hydrolyzing in an aqueous system a coupling agent represented by the formula:

$$C_nH_{2n+1}—Si—(OC_mH_{2m+1})_3$$

wherein n represents an integer of 3 to 12 and m represents an integer of 1 to 3;

and have a weight average particle diameter of from 0.01 μm to 0.2 μm, have a hydrophobicity of from 40% to 80% and have a light transmittance of not less than 40% at 400 nm.

24. The two-component developer according to claim 18, wherein said carrier particle has silicon atoms and carbon atoms on its surface in the ratio that satisfies the condition of:

$$Si/C=0.1 \text{ to } 0.7$$

as the number of atoms present on the carrier particle surface as measured by X-ray photoelectron spectroscopy.

25. The two-component developer according to claim 18, wherein the organopolysiloxane resin that forms said organopolysiloxane resin coat layer contains an aminosilane coupling agent.

26. The two-component developer according to claim 18, wherein the organopolysiloxane resin that forms said organopolysiloxane resin coat layer contains an oxime hardening agent represented by the formula:

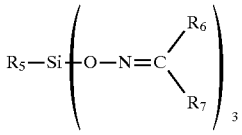

wherein $R_4$ is represents a substituent selected from the group consisting of a methyl group, an ethyl group, and a phenyl group; and $R_6$ and $R_7$ each represent a substituent selected from the group consisting of a methyl group and an ethyl group.

27. The two-component developer according to claim 26, wherein said organopolysiloxane resin contains the oxime hardening agent in an amount of from 0.1 part by weight to 10 parts by weight based on 100 parts by weight of organopolysiloxane.

28. The two-component developer according to claim 18, wherein the organopolysiloxane resin layer has a coating weight that satisfies the following relation, when coating weight based on 100 g of carrier cores is represented by a g, and specific surface area of the carrier particles formed after coating is represented by S $cm^2/g$:

$$(a/S)\times10^4=2 \text{ to } 30$$

where a is 0.01 to 1.0.

29. The two-component developer according to claim 18, wherein the organopolysiloxane resin layer has a coating weight that satisfies the following relation, when coating weight based on 100 g of carrier cores is represented by a g, and specific surface area of the carrier particles formed after coating is represented by S $cm^2/g$:

$$(a/S)\times10^4=5 \text{ to } 20$$

where a is 0.01 to 1.0.

30. The two-component developer according to claim 18, wherein said carrier has a specific surface area of from 280 $cm^2/g$ to 600 $cm^2/g$.

31. The two-component developer according to claim 18, wherein said carrier has a specific surface area of from 300 cm2/g to 560 cm2/g.

32. The two-component developer according to claim 18, wherein said carrier has a weight average particle diameter of from 25 $\mu$m to 65 $\mu$m, and contains, in its weight distribution, 1 to 40% by weight of carrier particles with particle diameters of not smaller than 26 $\mu$m to smaller than 35 $\mu$m, 5 to 40% by weight of carrier particles with particle diameters of not smaller than 35 $\mu$m to smaller than 43 $\mu$m and not more than 2% by weight of carrier particles with particle diameters of not smaller than 74 $\mu$m.

33. The two-component developer according to claim 18, wherein said carrier has a weight average particle diameter of from 30 $\mu$m to 65 $\mu$m, and contains, in its weight distribution, 1 to 40% by weight of carrier particles with particle diameters of not smaller than 26 $\mu$m to smaller than 35 $\mu$m, 5 to 40% by weight of carrier particles with particle diameters of not smaller than 35 $\mu$m to smaller than 43 $\mu$m and not more than 2% by weight of carrier particles with particle diameters of not smaller than 74 $\mu$m.

34. The two-component developer according to claim 18, wherein said carrier has an electrical current value of from 30 $\mu$A to 140 $\mu$A when a voltage of 500 V is applied.

35. The two-component developer according to claim 18, wherein said organopolysiloxane resin coat layer is formed using a resin composition containing i) an organopolysiloxane resin comprised of an aggregate of segments represented by the following Formulas (I) to (III) and ii) compounds represented by the following Formulas (IV) and (V):

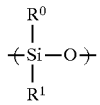

(I)

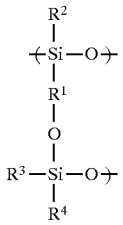

(II)

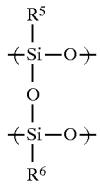

(III)

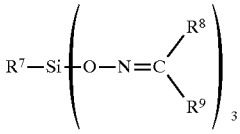

(IV)

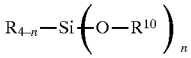

(V)

wherein $R^0$ to $R^{10}$ each represent a hydrocarbon group selected from the group consisting of a methyl group, an ethyl group, a phenyl group and a vinyl group; R represents a hydrocarbon group which may be substituted with an electron-donative group; and n represents an integer of 1 to 3.

36. The two-component developer according to claim 35, wherein said segments (I) to (III) are in the ratio that satisfies the condition of:

(I)/(II+III)=1/99 to 60/40 and (II)/(III)=10/90 to 100/0.

37. The two-component developer according to claim 35, wherein said segments (I) to (III) are in the ratio that satisfies the condition of:

(I)/(II+III)=2/88 to 50/50 and (II)/(III)=30/70 to 100/0.

38. The two-component developer according to claim 18, wherein said organopolysiloxane resin coat layer contains an aminosilane coupling agent represented by the formula:

wherein R represents an alkoxyl group, Y represents a hydrocarbon group containing an amino group, m represents an integer of 1 to 3, and n represents an integer of 3 to 1; and said carrier has a weight average particle diameter of from 25 μm to 60 μm and has an electrical current value of from 20 μA to 150 μA when a voltage of 500 V is applied.

39. An image forming method comprising:

rotationally transporting a two component developer having a toner and a carrier, onto a developer carrying member; and developing in a developing zone defined by a latent image bearing member and the developer carrying member provided opposingly thereto, a latent image borne on the latent image bearing member, using a toner of the two-component developer carried on the developer carrying member wherein:

said carrier comprises carrier particles, and each carrier particle comprises a carrier core and an organopolysiloxane resin coat layer that covers the carrier core;

said carrier particle has silicon atoms and carbon atoms on its surface in the ratio that satisfies the condition of:

Si/C=0.1 to 2.0 as the number of atoms present on the carrier particle surface as measured by X-ray photoelectron spectroscopy; and from 0.1% by number to 5% by number of metal atoms are present on the carrier particle surface;

said carrier has a weight average particle diameter of from 25 μm to 65 μm, and contains, in its weight distribution, 1 to 40% by weight of carrier particles with particle diameters of not smaller than 26 μm to smaller than 35 μm; and said carrier has an electrical current value of from 20 μA to 150 μA when a voltage of 500 V is applied.

40. The image forming method according to claim 39, wherein in said developing zone a developing electric field is formed between the latent image bearing member and the developer carrying member by applying to the developer carrying member a first voltage for directing the toner from the latent image bearing member toward the developer carrying member, a second voltage for directing the toner from the developer carrying member toward the latent image bearing member and a third voltage intermediate between the first voltage and the second voltage, to develop the latent image beared on the latent image bearing member, using the toner of the two component developer carried on the developer carrying member.

41. The image forming method according to claim 40, wherein the time for which the third voltage intermediate between the first voltage and the second voltage is applied to the developer carrying member is made longer than the time ($T_1$) for which the first voltage for directing the toner from the latent image bearing member toward the developer carrying member and the second voltage for directing the toner from the developer carrying member toward the latent image bearing member are applied to the developer carrying member.

42. The image forming method according to claim 40, wherein the developing bias comprises a succession of voltages including (i) at least one cycle of a first voltage for directing the toner from the latent image bearing member toward the developer carrying member and a second voltage for directing the toner from the developer carrying member toward the latent image bearing member, and (ii) a third voltage intermediate between the first voltage and the second voltage, wherein the time for which the third voltage is longer than the time ($T_1$) for which said at least one cycle of the first voltage and the second voltage.

43. The image forming method according to claim 39, wherein in said developing zone an electric field in which the toner is directed from the latent image bearing member toward the developer carrying member and an electric field in which the toner is directed from the developer carrying member toward the latent image bearing member are formed at least once between the latent image bearing member and the developer carrying member, and thereafter an electric field in which the toner is directed from the developer carrying member toward the latent image bearing member in an image area of the latent image bearing member and an electric field in which the toner is directed from the latent image bearing member toward the developer carrying member in a non-image area of the latent image bearing member are formed to develop the latent image borne on the latent image bearing member, using the toner of the two-component developer carried on the developer carrying member.

44. The image forming method according to claim 43, wherein the time for forming the electric field in which the toner is directed from the developer carrying member toward the latent image bearing member in an image area of the latent image bearing member and the electric field in which the toner is directed from the latent image bearing member toward the developer carrying member in a non-image area of the latent image bearing member is made longer than the total time ($T_1$) for forming the electric field in which the toner is directed from the latent image bearing member toward the developer carrying member and the electric field in which the toner is directed from the developer carrying member toward the latent image bearing member.

45. The image forming method according to claim 39, wherein said developer carrying member has a magnet roller built therein, and said two component developer is rotationally transported onto the developer carrying member while both the magnet roller and the developer carrying member are set rotary or while the magnet roller is set stationary and the developer carrying member is set rotary.

46. The image forming method according to claim 39, wherein;

said developer carrying member has a magnet roller built therein, and said two component developer is rotationally transported onto the developer carrying member while both the magnet roller and the developer carrying member are set rotary or while the magnet roller is set stationary and the developer carrying member is set rotary;

in said developing zone an electric field in which the toner is directed from the latent image bearing member toward the developer carrying member and an electric field in which the toner is directed from the developer carrying member toward the latent image bearing member are formed at least once between the latent image bearing member and the developer carrying member, and thereafter an electric field in which the toner is directed from the developer carrying member toward the latent image bearing member in an image area of the latent image bearing member and an electric field in which the toner is directed from the latent image bearing member toward the developer carrying member in a non-image area of the latent image bearing member are formed to develop the latent image beared on the latent image bearing member, using the toner of the two component developer carried on the developer carrying member, wherein the time for forming the electric field in which the toner is directed from the developer carrying member toward the latent image bearing member in an image area of the latent image bearing member and the electric field in which the toner is directed from the latent image bearing member toward the developer carrying member in a non-image area of the latent image bearing member is made longer than the total time ($T_1$) for forming the electric field in which the toner is directed from the latent image bearing member toward the developer carrying member and the electric field in which the toner is directed from the developer carrying member toward the latent image bearing member;

said organopolysiloxane resin coat layer of said carrier comprises a cross-linkable organopolysiloxane resin containing an aminosilane coupling agent represented by the formula:

$$R_m Si—Y_n$$

wherein R represents an alkoxyl group, Y represents a hydrocarbon group containing an amino group, m represents an integer of 1 to 3, and n represents an integer of 3 to 1; and said carrier has a weight average particle diameter of from 25 μm to 60 μm and has an electrical current value of from 20 μA to 150 μA when a voltage of 500 μA is applied: and said toner has a weight average particle diameter of from 1 μm to 10 μm, and a surface-treated titanium oxide having a weight average particle diameter of from 0.01 to 0.2 μm is externally added to said toner.

47. The image forming method according to claim 39, wherein said toner has an external additive with an average particle diameter of not larger than 0.2 μm.

48. The image forming method according to claim 39, wherein said toner has an external additive with an average particle diameter of from 0.002 μm to 0.2 μm.

49. The image forming method according to claim 39, wherein said toner has a weight average particle diameter of from 1 μm to 10 μm, and a surface-treated titanium oxide having a weight average particle diameter of from 0.01 to 0.2 μm is externally added to said toner.

50. The image forming method according to claim 39, wherein fine titanium oxide particles are externally added to said toner, and the fine titanium oxide particles have been surface-treated while hydrolyzing in an aqueous system a coupling agent represented by the formula:

$$C_nH_{2n+1}—Si—(OC_mH_{2m+1})_3$$

wherein n represents an integer of 3 to 12 and m represents an integer of 1 to 3;

and have a weight average particle diameter of from 0.01 μm to 0.2 μm, have a hydrophobicity of from 40% to 80% and have a light transmittance of not less than 40% at 400 nm.

51. The image forming method according to claim 39, wherein said carrier particle has silicon atoms and carbon atoms on its surface in the ratio that satisfies the condition of:

$$Si/C=0.1 \text{ to } 0.7$$

as the number of atoms present on the carrier particle surface as measured by X-ray photoelectron spectroscopy.

52. The image forming method according to claim 51, wherein said organopolysiloxane resin that forms the organopolysiloxane resin coat layer further contains a coupling agent represented by the formula:

$$R_{4-a}—Si—Xa$$

wherein $R_{4-a}$ represents a member selected from the group consisting of a vinyl group, a methacrylic group, an epoxy group, an amino group, and a mercapto group; a is 3; and X represents a member selected from the group consisting of a halogen atom and an alkoxyl group.

53. The image forming method according to claim 39, wherein the organopolysiloxane resin that forms said organopolysiloxane resin coat layer contains an aminosilane coupling agent.

54. The image forming method according to claim 39, wherein the organopolysiloxane resin that forms said organopolysiloxane resin coat layer contains an oxime hardening agent represented by the formula:

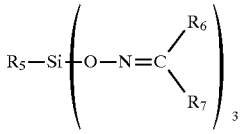

wherein $R_5$ represents a substituent selected from the group consisting of a methyl group, an ethyl group, and a phenyl group; and $R_6$ and $R_7$ each represent a substituent selected from the group consisting of a methyl group and an ethyl group.

55. The image forming method according to claim 54, wherein said organopolysiloxane resin contains the oxime hardening agent in an amount of from 0.1 part by weight to 10 parts by weight based on 100 parts by weight of organopolysiloxane.

56. The image forming method according to claim 39, wherein the organopolysiloxane resin layer has a coating weight that satisfies the following relation, when coating weight based on 100 g of carrier cores is represented by a g, and specific surface area of the carrier particles formed after coating is represented by S $cm^2/g$:

$$(a/S)\times10^4=2 \text{ to } 30$$

where a is 0.01 to 1.0.

57. The image forming method according to claim 39, wherein the organopolysiloxane resin layer has a coating weight that satisfies the following relation, when coating weight based on 100 g of carrier cores is represented by a g, and specific surface area of the carrier particles formed after coating is represented by S $cm^2/g$:

$$(a/S)\times10^4=5 \text{ to } 20$$

where a is 0.01 to 1.0.

58. The image forming method according to claim 39, wherein said carrier has a specific surface area of from 280 $cm^2/g$ to 600 $cm^2/g$.

59. The image forming method according to claim 39, wherein said carrier has a specific surface area of from 300 $cm^2g/$ to 560 $cm^2/g$.

60. The image forming method according to claim 39, wherein said carrier has a weight average particle diameter of from 25 μm to 65 μm, and contains, in its weight distribution, 1 to 40% by weight of carrier particles with particle diameters of not smaller than 26 μm to smaller than 35 μm, 5 to 40% by weight of carrier particles with particle diameters of not smaller than 35 μm to smaller than 43 μm and not more than 2% by weight of carrier particles with particle diameters of not smaller than 74 μm.

61. The image forming method according to claim 39, wherein said carrier has a weight average particle diameter of from 30 μm to 65 μm, and contains, in its weight distribution, 1 to 40% by weight of carrier particles with particle diameters of not smaller than 26 μm to smaller than 35 μm, 5 to 40% by weight of carrier particles with particle diameters of not smaller than 35 μm to smaller than 43 μm and not more than 2% by weight of carrier particles with particle diameters of not smaller than 74 μm.

62. The image forming method according to claim 39, wherein said carrier has an electrical current value of from 30 μA to 140 μA when a voltage of 500 V is applied.

63. The image forming method according to claim 39, wherein said organopolysiloxane resin coat layer is formed using a resin composition containing i) an organopolysiloxane resin comprised of an aggregate of segments represented by the following Formulas (I) to (III) and ii) compounds represented by the following Formulas (IV) and (V):

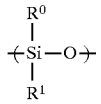

(I)

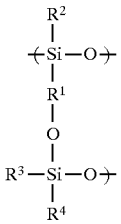

(II)

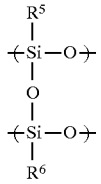

(III)

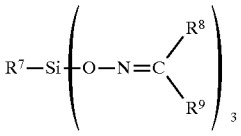

(IV)

-continued (V)

wherein $R^0$ to $R^{10}$ each represent a hydrocarbon group selected from the group consisting of a methyl group, an ethyl group, a phenyl group and a vinyl group; R represents a hydrocarbon group which may be substituted with an electron-donative group; and n represents an integer of 1 to 3.

64. The image forming method according to claim 63, wherein said segments (I) to (III) are in the ratio that satisfies the condition of:

(I)/(II+III)=1/99 to 60/40 and (II)/(III)=10/90 to 100/0.

65. The image forming method according to claim 63, wherein said segments (I) to (III) are in the ratio that satisfies the condition of:

(I)/(II+III)=2/88 to 50/50 and (II)/(III)=30/70 to 100/0.

66. The image forming method according to claim 39, wherein said organopolysiloxane resin coat layer contains an aminosilane coupling agent represented by formula:

$$R_m Si—Y_n$$

wherein R represents an alkoxyl group, Y represents a hydrocarbon group containing an amino group, m represents an integer of 1 to 3, and n represents an integer of 3 to 1; and said carrier has a weight average particle diameter of from 25 μm to 60 μm and has an electrical current value of from 20 μA to 150 μA when a voltage of 500 V is applied.

67. The image forming method according to claim 39, wherein the latent image is developed with the toner of the two component developer while applying to the developer carrying member a developing bias comprising an intermittent alternation to form a developing electric field between the latent image bearing member and the developer carrying member.

* * * * *

UNITED STATES PATENT AND TRADEMARK OFFICE

CERTIFICATE OF CORRECTION

PATENT NO. : 5,885,742

DATED : March 23, 1999

INVENTOR(S) : KENJI OKADO, ET AL.

It is certified that error appears in the above-identified patent and that said Letters Patent is hereby corrected as shown below:

On the title page,

AT [56] REFERENCES CITED

U.S. PATENT DOCUMENTS

Insert: --5,258,253 11/1993 Fukumoto et al.--.

AT [56] REFERENCES CITED

FOREIGN PATENT DOCUMENTS

Insert: --0334099 9/1989 European Pat. Off.--

AT [57] ABSTRACT

Line 19, "developer" should read --develops--.

COLUMN 2

Line 23, "the" should be deleted.

COLUMN 5

Line 22, "tone" should read --toner--; and
Line 45, "of urgent" should read --urgent--.

COLUMN 9

Line 42, "beared" should read --borne--.

COLUMN 12

Line 16, "a is 3;" should read
--a is an integer from 1 to 3;--.

UNITED STATES PATENT AND TRADEMARK OFFICE

CERTIFICATE OF CORRECTION

PATENT NO. : 5,885,742

DATED : March 23, 1999

INVENTOR(S) : KENJI OKADO, ET AL.

It is certified that error appears in the above-identified patent and that said Letters Patent is hereby corrected as shown below:

COLUMN 13

Line 59, "very" should be deleted.

COLUMN 22

Line 23, "has" should read --have--; and
Line 46, "materials" should read --material--.

COLUMN 23

Line 49, "beared" should read --borne--; and
Line 63, "beared" should read --borne--.

COLUMN 24

Line 39, "beared" should read --borne--.

COLUMN 25

Line 1, "beared" should read --borne--.

COLUMN 30

Line 60, "pull" should read --pulled--.

UNITED STATES PATENT AND TRADEMARK OFFICE

CERTIFICATE OF CORRECTION

PATENT NO. : 5,885,742

DATED : March 23, 1999

INVENTOR(S) : KENJI OKADO, ET AL.

It is certified that error appears in the above-identified patent and that said Letters Patent is hereby corrected as shown below:

COLUMN 33

Line 12, "was" should be deleted; and
Line 13, "added" should be deleted.

COLUMN 34

Line 30, "silicone" should be deleted. (second occurrence)

COLUMN 37

Table 2, "23 40 μm," should read --23 50 μm,--; and
Table 2, "24 40 μm," should read --24 60 μm,--.

COLUMN 42

Line 40, "sample" should read --sample.--.

COLUMN 43

Line 3, "hours" should read --hour--.

COLUMN 48

Table 8, " ≧74 82 m:" should read --≧74 μm:--.

COLUMN 49

Table 8, "≧74 82 m:" should read --≧74 μm:--.

UNITED STATES PATENT AND TRADEMARK OFFICE

CERTIFICATE OF CORRECTION

PATENT NO. : 5,885,742

DATED : March 23, 1999

INVENTOR(S) : KENJI OKADO, ET AL. Page 4 of 5

It is certified that error appears in the above-identified patent and that said Letters Patent is hereby corrected as shown below:

COLUMN 57

Line 22, "used,therein" should read --used therein--.

COLUMN 61

Line 34, "$R^3$–Si–O)–" should read --$R^3$–(Si–O)–--.

COLUMN 63

Line 24, "is" should be deleted; and
Line 58, "cm2/g to 560 cm2/g." should read --$cm^2$/g to 560 $cm^2$/g.--.

COLUMN 64

Line 30, "$R^3$–Si–O)–" should read --$R^3$–(Si–O)–--; and
Line 67, "formula:" should read --formula: $R_mSi-Y_n$--.

COLUMN 65

Line 7, "two component" should read --two-component--;
Line 48, "beared" should read --borne--; and
Line 49, "two component" should read --two-component--.

COLUMN 66

Line 38, "two component" should read --two-component--;
Line 46, "two component" should read --two-component--; and
Line 67, "beared" should read --borne--.

UNITED STATES PATENT AND TRADEMARK OFFICE

CERTIFICATE OF CORRECTION

PATENT NO. : 5,885,742

DATED : March 23, 1999

INVENTOR(S) : KENJI OKADO, ET AL. Page 5 of 5

It is certified that error appears in the above-identified patent and that said Letters Patent is hereby corrected as shown below:

COLUMN 67

Line 30, "applied: and" should read --applied; and--.

COLUMN 69

Line 34, "$R^3$–Si–O)–" should read --$R^3$–(Si–O)---.

Signed and Sealed this

Fourteenth Day of December, 1999

Attest:

Q. TODD DICKINSON

Attesting Officer

Acting Commissioner of Patents and Trademarks